US007527005B2

(12) United States Patent
Matsumoto et al.

(10) Patent No.: US 7,527,005 B2
(45) Date of Patent: May 5, 2009

(54) CIRCULAR STITCHER FOR SEWING MACHINE AND SEWING MACHINE

(75) Inventors: Nobuaki Matsumoto, Nagoya (JP); Yasuhiro Watanabe, Tokoname (JP); Kazutoshi Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/071,883

(22) Filed: Feb. 27, 2008

(65) Prior Publication Data

US 2008/0223276 A1 Sep. 18, 2008

(30) Foreign Application Priority Data

Mar. 15, 2007 (JP) ..... 2007-066089
Sep. 19, 2007 (JP) ..... 2007-242521

(51) Int. Cl.
*D05B 3/04* (2006.01)
*D05B 23/00* (2006.01)

(52) U.S. Cl. ..... 112/470.17

(58) Field of Classification Search ..... 112/470.17, 112/470.14, 470.11, 136, 308
See application file for complete search history.

(56) References Cited

U.S. PATENT DOCUMENTS 1,682,362 A * 8/1928 Von Halle ..... 2/255
2,717,566 A 3/1955 Szczepanski et al.
3,046,918 A * 7/1962 Hess ..... 112/470.17
3,374,753 A * 3/1968 Rakacs ..... 112/470.17
3,410,237 A * 11/1968 Hanyu ..... 112/102
5,119,745 A 6/1992 Terry

FOREIGN PATENT DOCUMENTS

JP U-62-023681 2/1987
JP U-62-023682 2/1987
JP U-04-000375 1/1992
JP A-04-073086 3/1992
JP Y2-08-000061 1/1996

* cited by examiner

*Primary Examiner*—Ismael Izaguirre
(74) *Attorney, Agent, or Firm*—Oliff & Berridge, PLC

(57) ABSTRACT

A circular stitcher for a sewing machine having a bed and a needle plate, and a feed dog includes a base attachable to an upper surface of the bed or the needle plate; a pin support seized movably in a predetermined direction by the base and having an engagement subject; a pin having an engagement engagable with the engagement subject of the pin support and a needle that pierces a workpiece cloth from an underside of the workpiece cloth at a laterally spaced position from a needle drop point, the needle assuming a center of rotational cloth feed executed by the feed dog during circular stitching; and a lock mechanism provided in the pin support and releasably locking the engagement and the engagement subject together.

20 Claims, 25 Drawing Sheets

CIRCULAR STITCHER FOR SEWING MACHINE AND SEWING MACHINE

This application is based upon and claims the benefit of priority from the prior Japanese Patent Applications 2007-066089, filed on, Mar. 15, 2007, and 2007-242521, filed on, Sep. 19, 2007 the entire contents of which are incorporated herein by reference.

FIELD

The present disclosure relates to a circular stitcher for a sewing machine allowing secure detachable attachment of a pin having a needle for piercing the workpiece cloth. The circular stitcher of the present disclosure eliminates rattling of the pin. The present disclosure also relates to a sewing machine provided with the circular stitcher.

BACKGROUND

Conventionally, when forming circular stitches with a sewing machine, a circular stitcher having a pin secured to it is attached to the sewing machine by the user. The pin is pierced through a workpiece cloth at a position laterally spaced from the needle drop point. Then, the workpiece cloth is rotated about the pin by the feed dog to form circular stitches in combination with the vertical movement of the needle bar having a sewing needle attached to it.

When forming circular stitches, the user is required to adjust the alignment of the workpiece cloth so that the center of rotation for forming circular stitches is pierced by the pin secured on the circular stitcher attached to the sewing machine. Because the pin is secured to the circular stitcher, precise cloth alignment is difficult and troublesome for the user since the user is required to peek under the workpiece cloth for adjustment in alignment. Consequently, the center of rotation for forming circular stitches is often displaced, resulting in patterns being formed in undesired positions.

A circular stitcher allowing detachable attachment of the pin to the stitcher body is suggested to address such issues.

The circular stitching unit described in JP H04-375 U (related publication 1) is provided with a stopper plate having three stopper holes. A needle base plate provided with a pin is detachably attached to the three stopper holes. The user may selectively attach the needle base plate to one of the three stopper holes of the stopper plate in order to position the pin to the center of the circular stitching.

The circular stitching unit described in related publication 1 allows detachable attachment of the needle base plate to the stopper plate. However, under such configuration, increase in clearance between the stopper hole of the stopper plate and the needle base plate for facilitating attachment/detachment of the needle base plate to/from the stopper plate renders the needle base plate susceptible to rattling, consequently leading to displacement in circular stitch patterns.

As opposed to this, when clearance between the stopper hole of the stopper plate and the needle base plate is reduced to eliminate rattling of the needle base plate caused by the attachment of the needle base plate, attachment/detachment of the needle base plate to/from the stopper hole becomes troublesome.

SUMMARY

An object of the present disclosure is to provide a circular stitcher for a sewing machine that can be attached to/detached from the sewing machine with ease and that prevents rattling of the attached pin pivotably securing the workpiece cloth. Another object of the present disclosure is to provide a sewing machine including such circular stitcher.

The circular stitcher of the present disclosure includes a base attachable to an upper surface of the sewing machine bed or the needle plate; a pin support seized movably in a predetermined direction by the base and having an engagement subject; a pin having an engagement engagable with the engagement subject of the pin support and a needle that pierces the workpiece cloth from an underside of the workpiece cloth at a position laterally spaced from a needle drop point, the needle assuming a center of rotational cloth feed executed by the feed dog during circular stitching; and a lock mechanism provided in the pin support and releasably locking the engagement and the engagement subject together.

According to the above construction, after the engagement of the pin and the engagement subject of the pin support are engaged with the other, the lock mechanism effects a lock to maintain the engagement. The pin is thus attached to the pin support. The pin can be removed from the pin support when the lock mechanism releases the engagement between the engagement and the engagement subject. Provision of such lock mechanism in the pin support allows attachment/detachment of the pin to/from the pin support, and prevents rattling of the pin when attached to the pin support.

The lock mechanism may arrange an engagement catch provided on the engagement subject to establish engagement with an engagement recess provided on the engagement against the elasticity of the elastic member. Such configuration allows the pin to be reliably seized by the pin support by the elasticity of the elastic member. The lock mechanism may move the engagement catch so as to be moved away from the engagement recess in response to the operation of the operating portion. Such configuration allows the user to readily remove the pin from the pin support by operating the operating portion.

The engagement and the needle may be disposed on the pin so as to be horizontally spaced apart from each other by a predetermined distance. According to such configuration, the height of the needle can be lowered independent of the height of the engagement and difference in height between the upper surface of the needle plate on which the workpiece cloth is placed and the upper surface of the base end of the needle can be reduced. Thus, the workpiece cloth can be fed with very little curves, thereby preventing the displacement in the sewing start position and the sewing end position of the circular stitch pattern.

The bottom surface of the pin may be projected downward so that the tip of the pin may be oriented sideways instead of being oriented upward. Such configuration allows the pin tip to be oriented sideways when the pin is removed from the pin support and placed on the floor, for example, thereby providing improved user safety.

A tab may be provided on the pin in the portion opposite the needle. Such configuration allows user attachment/detachment of the pin by holding the tab, eliminating the risk of the user contacting the needle of the pin, providing improved user safety.

A slope may be formed at least in the lower side of the engagement recess. Under such configuration, the elasticity of the elastic member downwardly presses the pin relative to the pin support to prevent the pin from rattling vertically relative to the pin support.

The lock mechanism may be arranged to effect a releasable lock on the engagement between the engagement recess of the engagement and the engagement projection of the engagement subject by elastic deformation of the engagement projection. Such configuration allows the structure of the lock mechanism to be simplified and reduce the number of parts.

The base may be configured to allow selective attachment in a first position where the pin support is located leftward relative to the needle drop point and a second position where the pin support is located rightward relative to the needle drop point. When the base is attached in the second position, the screw that secures the base on the upper surface of the bed or the needle plate may regulate the movement of the pin support to the needle drop point side.

According to such configuration, the pin can be prevented from interfering with a needle clamp or needle fastening screw that secure the sewing needle to the needle bar when the pin support is moved to the needle drop point side, thereby allowing safe execution of circular stitching.

A cloth slider may be provided on the pin support. The cloth slider is upwardly inclined towards the pin support so that the height of its upper surface increases towards the pin support. Thus, the workpiece cloth rotates with guidance of the cloth slider during circular stitching and the workpiece cloth is fed in a smoother fashion. The cloth slider may also be utilized as a handle to be held by the user to laterally move the pin support.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

A first exemplary embodiment of the present disclosure will be described hereinafter with reference to FIGS. 1 to 15.

Figure 1:
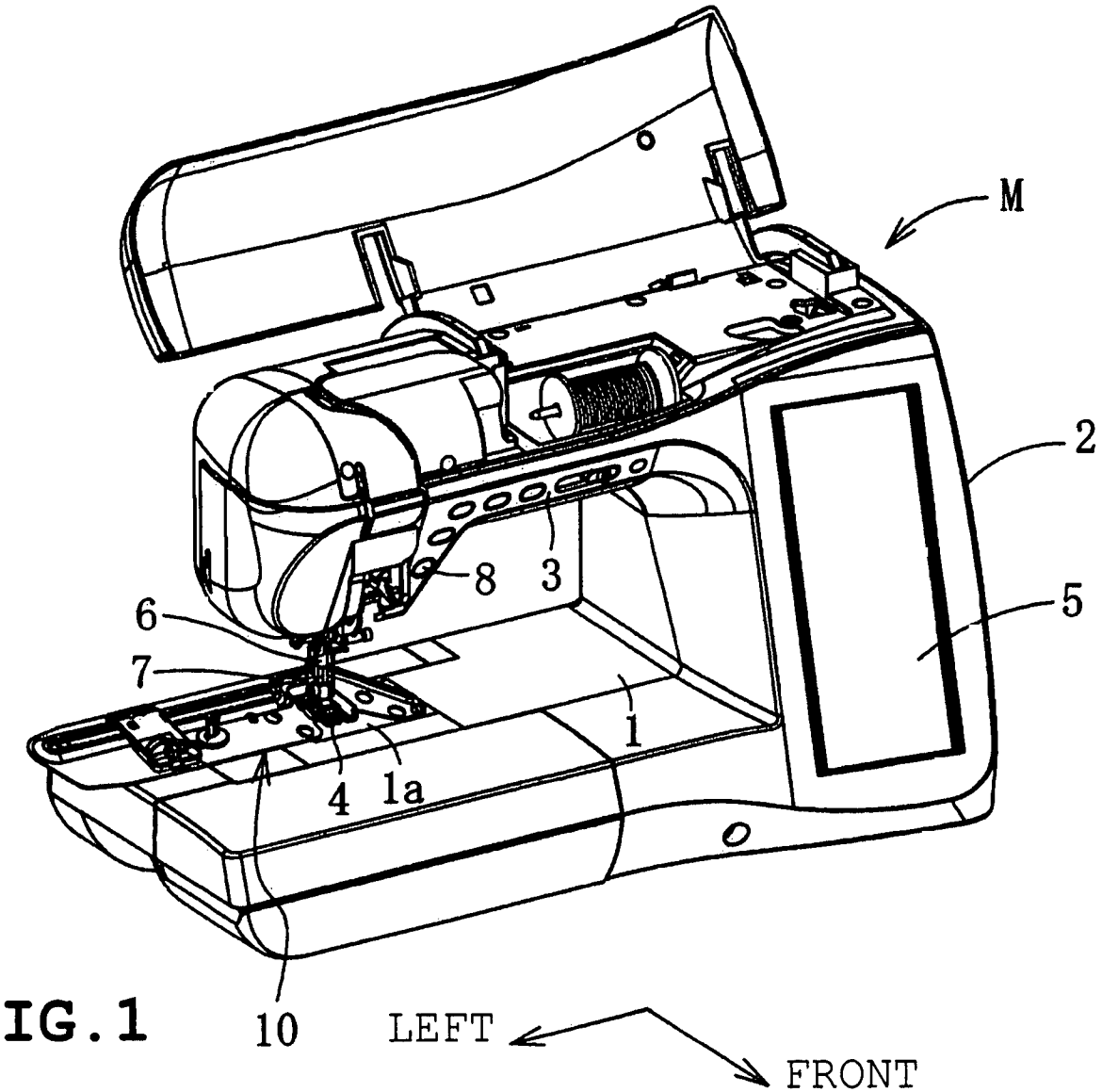
FIG. 1 is a perspective view of a circular stitcher attached to an electronic sewing machine in accordance with a first exemplary embodiment.

Referring to FIG. 1, the electronic sewing machine M includes a bed 1, a pillar 2 standing on the right end of the bed 1, and an arm 3 extending leftward over the bed 1 from the upper end of the pillar 2. Provided below a needle plate 1*a* placed on the upper surface of the bed 1 are a feed dog vertically moving mechanism (not shown) that vertically moves a feed dog 61 (refer to FIG. 3) feeding the workpiece, a feed dog longitudinally moving mechanism (not shown) for longitudinally moving the feed dog 61, a full rotary hook (not shown) that contains a bobbin (not shown) wound with bobbin thread and forming stitches in cooperation with the sewing needle 7, and a thread cutting mechanism (not shown) that cuts the needle thread and the bobbin thread.

Figure 3:
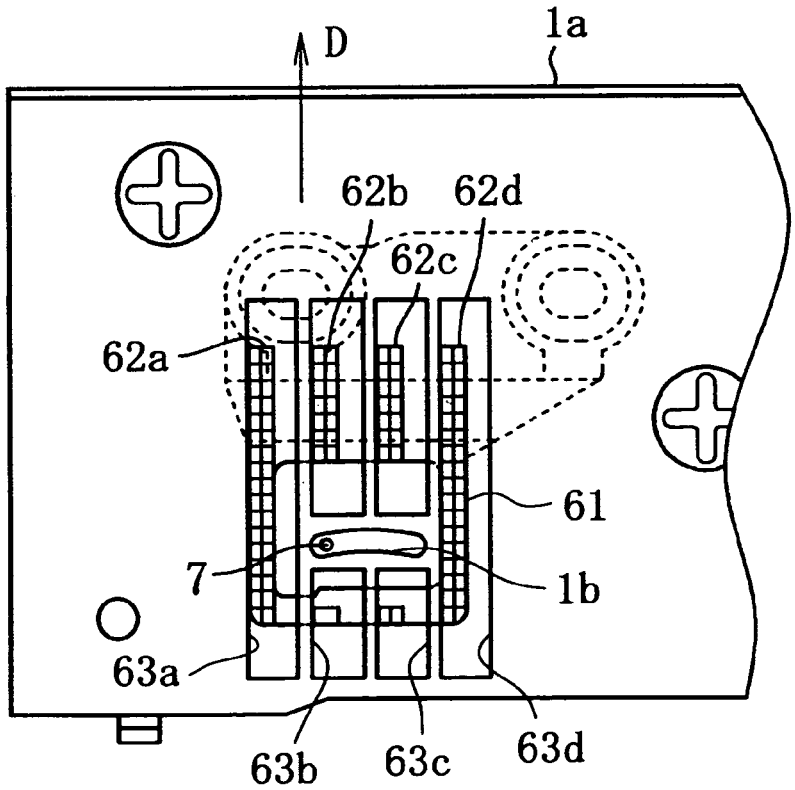
FIG. 3 is a plan view of a feed dog and its periphery.

Referring to FIG. 3, the needle plate 1*a* includes square holes 63*a* to 63*d* allowing a plurality of teeth 62*a* to 62*d* formed on the feed dog 61 to project/retract from them and a needle hole 1*b* allowing the sewing needle 7 to pass through, the needle hole 1*d* assuming a laterally elongate and curved form. The longitudinal length (cloth feed direction D of the feed dog 61) is configured in greater length than the maximum longitudinal feed amount of the feed dog 61.

A large LCD (liquid crystal display) 5 capable of color display is provided on the front face of the pillar 2. The LCD 5 displays screens such as the menu screen, the pattern input screen, and the pattern selection screen.

Figure 2:
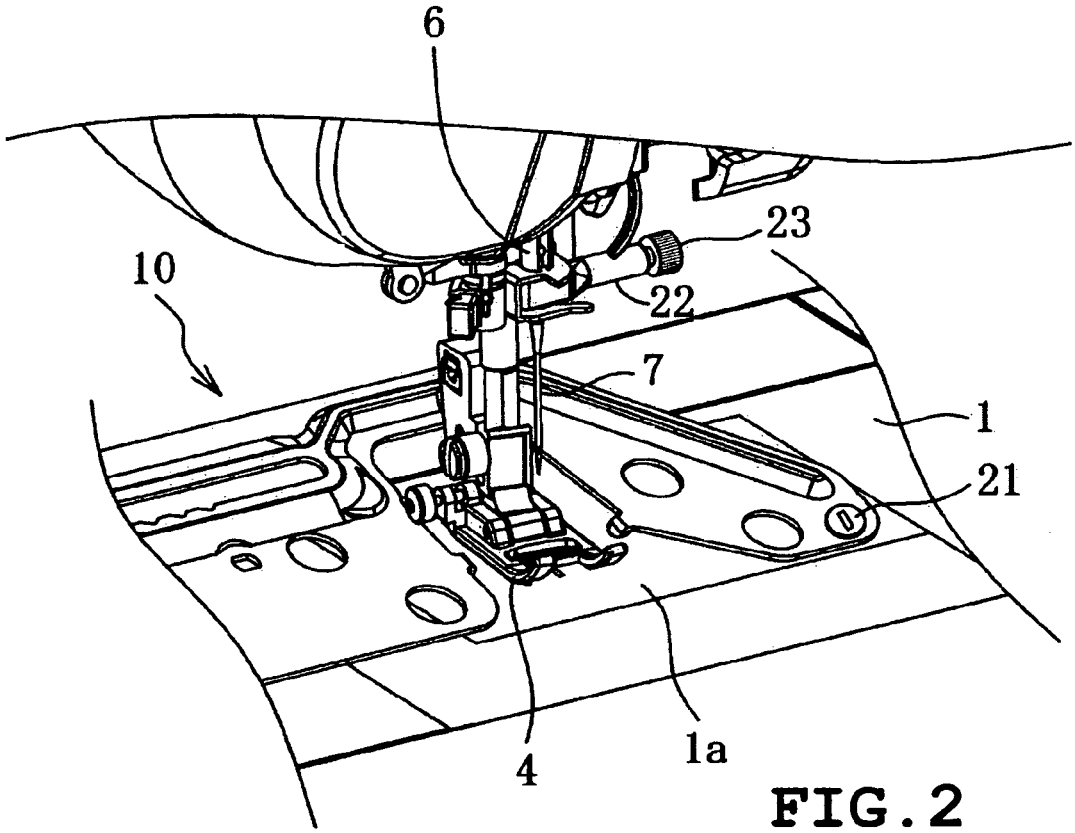
FIG. 2 is an enlarged view of a periphery of a sewing needle.

Provided in the arm 3 are a laterally-oriented sewing machine main shaft (not shown) being rotated by a sewing machine motor (not shown), a needle bar drive mechanism (not shown) that vertically moves a needle bar 6 (refer to FIG. 2) having a sewing needle 7 attached to its lower end, a needle swing mechanism (not shown) that swings the needle bar 6 in the direction perpendicular to a cloth feed direction D, and a thread take-up drive mechanism (not shown) that vertically moves a thread take-up in synchronization with the vertical movement of the needle bar 6. Referring to FIG. 2, the sewing needle 7 is attached to the needle bar 6 by a needle clamp 22 and a needle fastening screw 23. A presser foot 4 is disposed on the upper surface of the needle plate 1*a* for applying pressure on the workpiece cloth.

Various switches such as a sewing start/stop switch 8 for starting/stopping a sewing operation is provided on the front face of the arm 3. A circular stitcher 10 is attached on the upper surface of the needle plate 1*a*. A needle 18 (refer to FIG. 5) of the circular stitcher 10 is pierced through the workpiece cloth from the workpiece underside at a position laterally spaced from the needle hole 1*b* which may also be referred to as a needle drop point. The workpiece cloth is rotated about the needle 18 by the feed dog 61. The electronic sewing machine M executes circular stitching by rotating the workpiece cloth by the feed dog 61 and vertically moving the needle bar 6.

Next, a description will be given on the circular stitcher 10.

Figure 4:
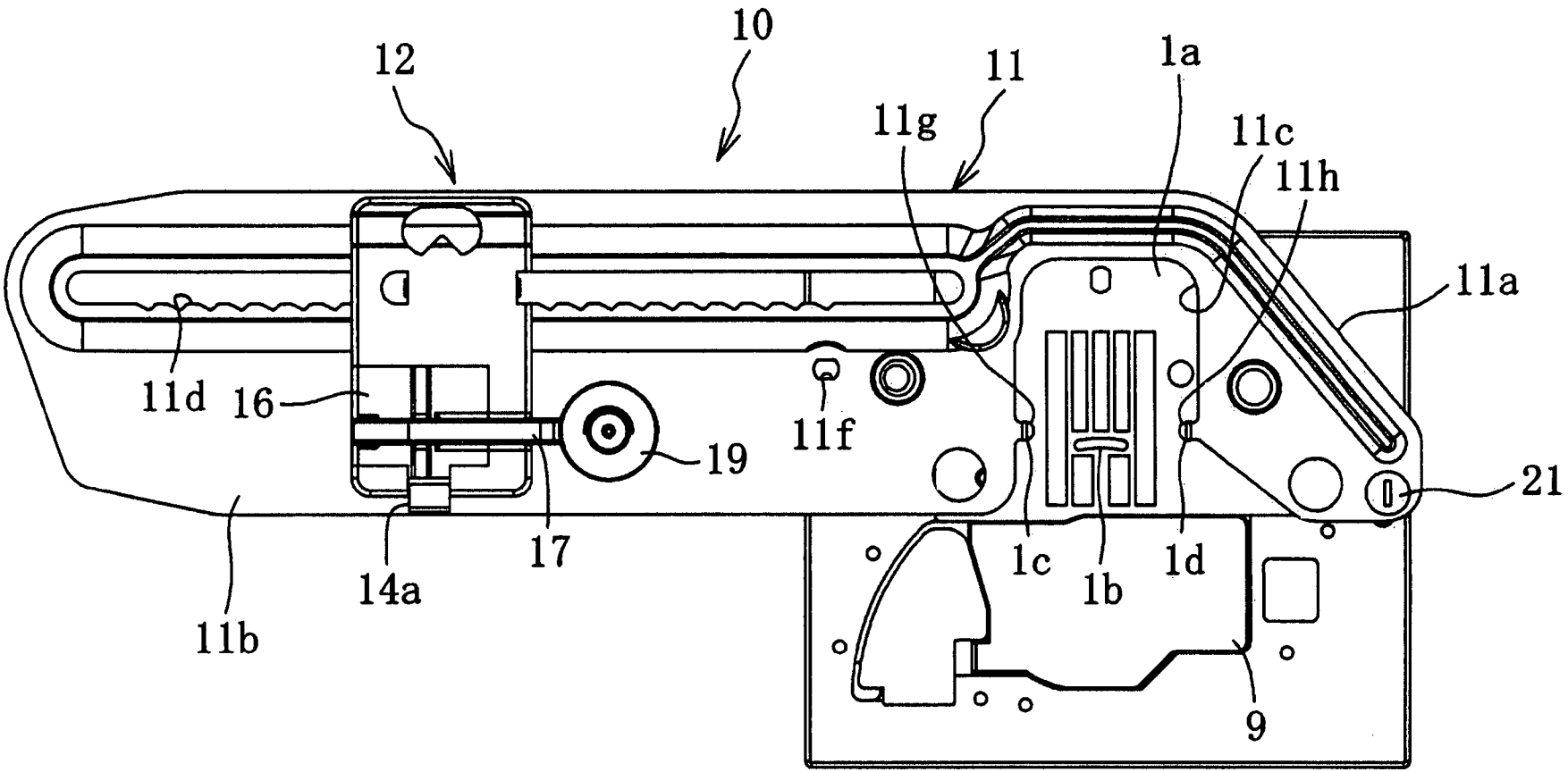
FIG. 4 is a plan view of the circular stitcher attached in a first position relative to a needle plate.

Referring to FIG. 4, the circular stitcher 10 includes a base 11 attachable to the upper surface of a needle plate 1*a*, a pin support 12 seized movably in a predetermined direction (laterally in the present exemplary embodiment) relative to the base 11, a pin 17 attachable to/detachable from the pin support 12, a lock mechanism 20 (refer to FIG. 5) that maintains engagement of the pin 17 with the pin support 12, and a needle cap 19 fitted on the needle 18 of the pin 17 penetrating the workpiece cloth from the workpiece underside. The needle cap 19 is made of soft synthetic resin and the elasticity of synthetic resin allows the needle cap 19 to be fitted on the needle 18.

The base 11 includes an attachment 11*a* which establishes attachment with the needle plate 1*a*, and a linear guide 11*b* extending from the attachment 11*a*. The base 11 is configured to be selectively attachable to a first position shown in FIG. 4 and a second position shown in FIG. 7. When the base 11 is attached in the first position, the pin support 12 is positioned in the left side of needle hole 1*b* of the needle plate 1*a*; whereas when the base 11 is attached in the second position, the pin support 12 is positioned in the right side of the needle hole 1*b*. The descriptions are given hereafter with an assumption that longitudinal and lateral directions of the base 11 when attached in the first position indicate the longitudinal and lateral directions of the circular stitcher 10.

Referring to FIG. 4, the attachment 11*a* has a forwardly opening aperture 11*c* formed to expose the front half of the needle plate 1*a*. Thus, when the circular stitcher 10 is attached in the first position relative to the needle plate 1*a*, the needle plate cover 9 can be readily opened/closed to allow attachment/detachment of the bobbin thread bobbin by opening the needle plate cover 9. A linear rail groove 11*d* is defined in the rear half portion of the guide 11*b* to provide guidance in laterally moving the pin support 12. A substantially V-shaped groove is defined on one inner-periphery of the rail groove 11*d* for holding the pin support 12 by elastic engagement with the pin support 12. The groove is defined at predetermined intervals (approximately 5 mm, for example) which allows adjustment of circular stitching radius in the unit of approximately 5 mm.

Figure 7:
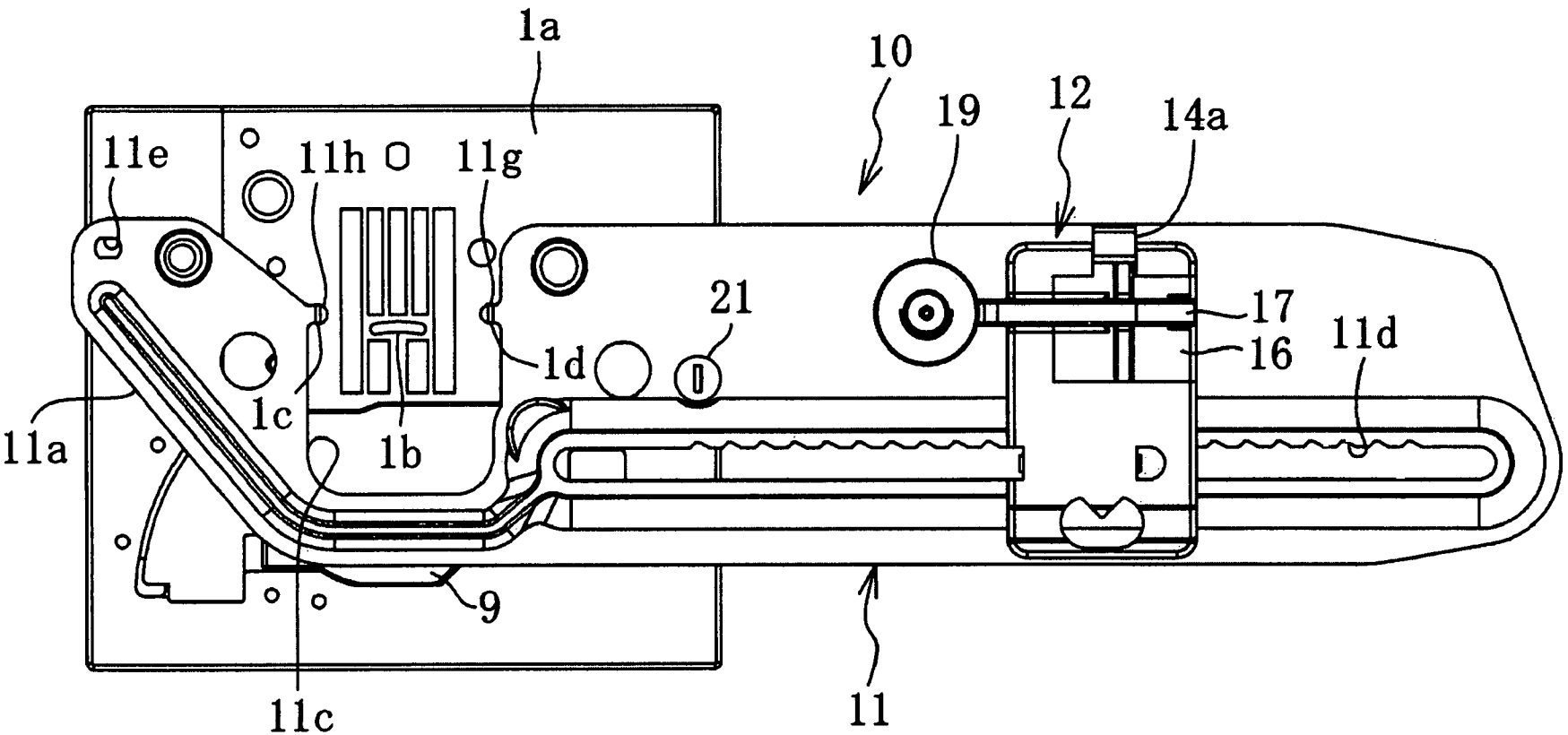
FIG. 7 is a plan view of the circular stitcher attached in a second position relative to a needle plate.
Figure 8:
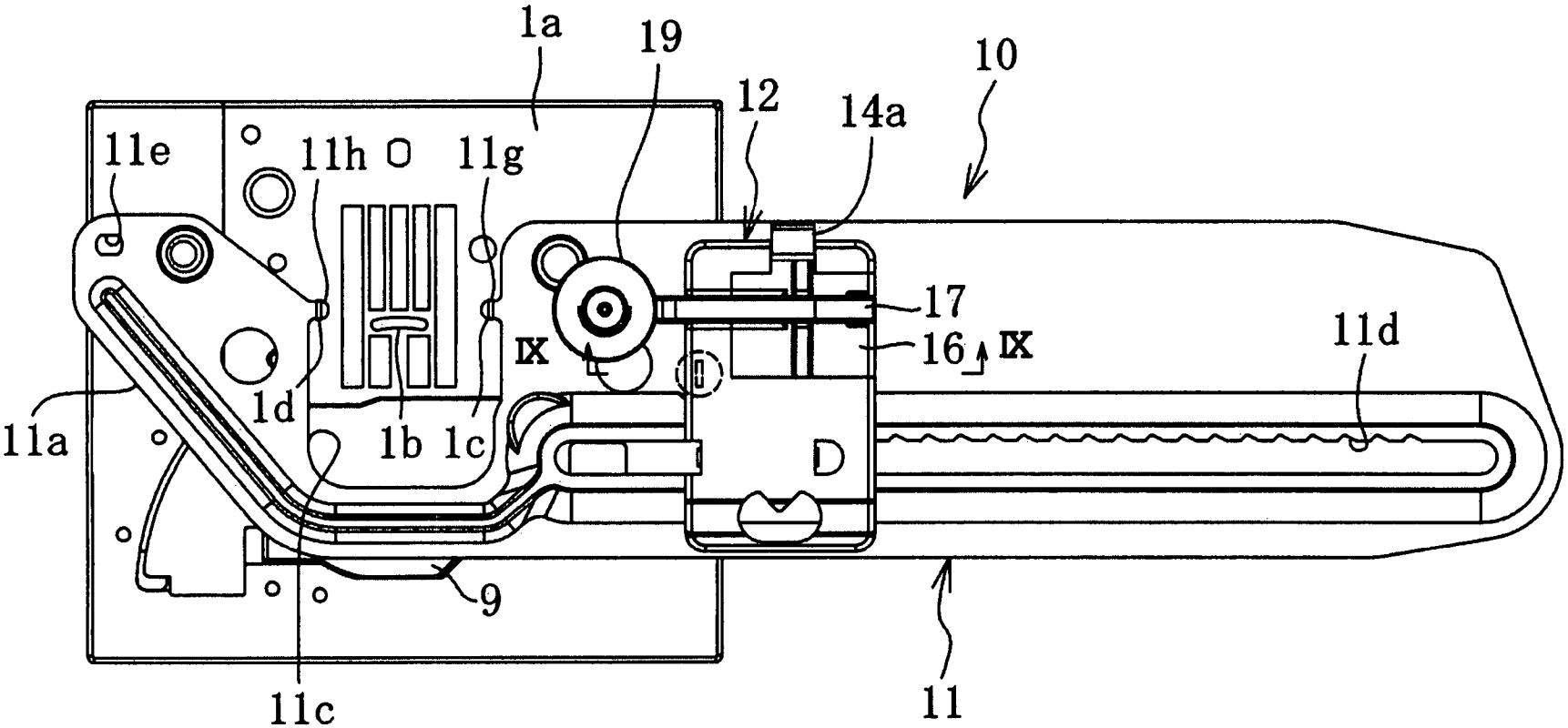
FIG. 8 is a plan view of the circular stitcher attached in a second position relative to the needle plate and the pin support moved to a needle hole side of the needle plate.

Referring to FIGS. 4 and 7, insertion holes 11*e* and 11*f* are formed in the right end proximity of the attachment 11*a* and the right end proximity of the guide 11*b*. The insertion holes 11*e* and 11*f* receive a screw 21 when securing the base 11 on the needle plate 1*a*. When attaching the base 11 in the first position, the screw 21 is inserted in the insertion hole 11*e*; whereas when attaching the base 11 in the second position, the screw 21 is inserted in the insertion hole 11*f*. In either case, the base 11 is secured on the needle plate 1*a* by screw engagement of the screw 21 with the screw hole (not shown) provided in the needle plate 1*a*.

A couple of mutually opposing protrusions 11*g* and 11*h* are provided at the front end side of the peripheral edge of the aperture 11*c*. The protrusions 11*g* and 11*h* are used for positioning of the base 11 when attaching the base 11 to the needle plate 1*a*. The protrusions 11*g* and 11*h* are respectively inserted to a couple of through holes 1*c* and 1*d* provided in the needle plate 1*a*. The attachment position (attachment disposition) of the base 11 is thus determined.

Next, a description will be given on the pin support 12.

Figure 5:
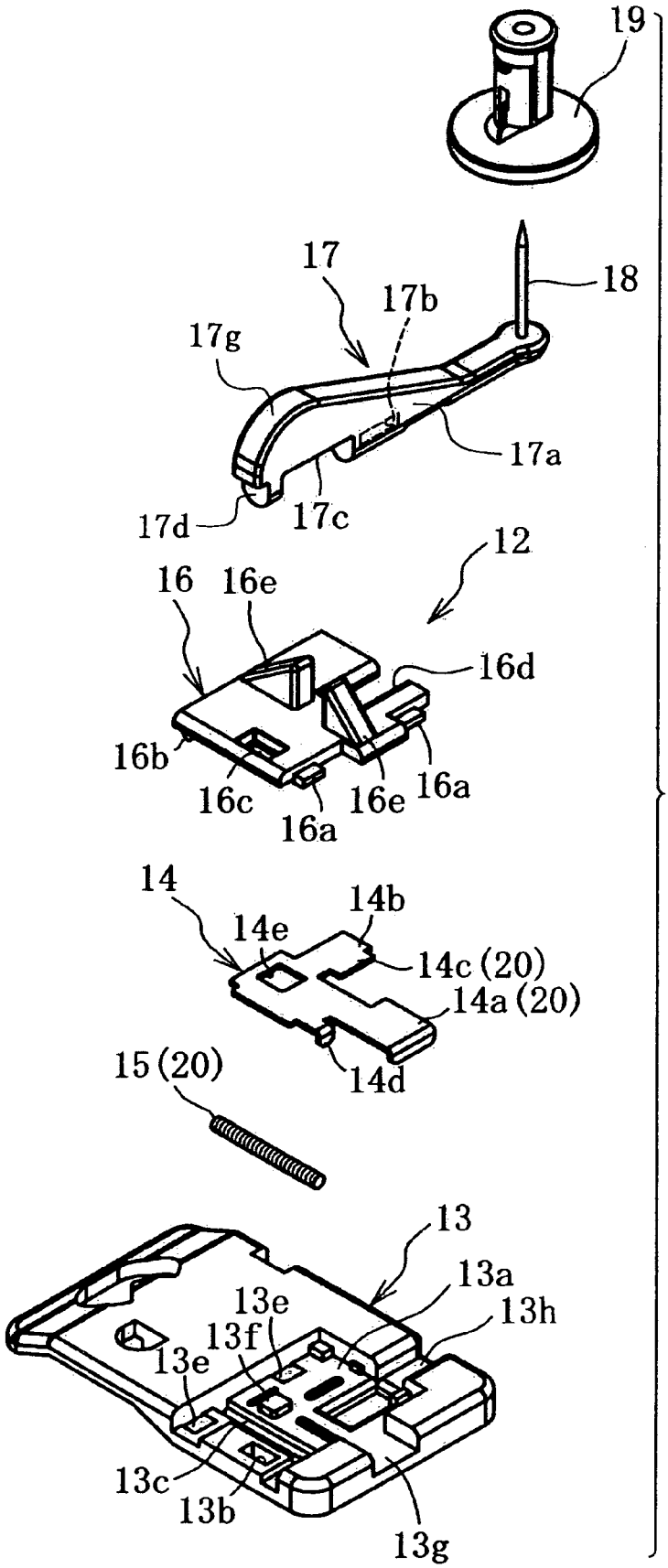
FIG. 5 is a perspective view of a needle cap, a pin, and an exploded view of a pin support.

Referring to FIG. 5, the pin support 12 includes a lower holder 13, an operation plate 14, an upper holder 16, and a compression spring 15. The pin support 12 is also provided with a lock mechanism 20 that effects releasable lock for maintaining the engagement of the engagement 17*a* with the engagement subject 14*b*. The lower holder 13 is formed in a substantially rectangular form in plan view. The longitudinal length of the lower holder 13 is slightly shorter than the longitudinal length of the guide 11*b* of the base 11. A recess 13*a* that accommodates the operation plate 14 and the upper holder 16 is provided in the front half of the top surface of the lower holder 13.

A recess 13*b* is defined in the left end portion of the recess 13*a* for fitting a projection 17*d* of the later described pin 17. A couple of engagement holes 13*d* (refer to FIG. 10) is defined on the front wall of the recess 13*a* and a couple of engagement holes 13*e* are defined on the rear end portion of the bottom wall of the recess 13*a*. The four engagement holes 13*d* and 13*e* are engaged with four catches 16*a* and 16*b* of the upper holder 16. A recess 13*c* elongated in the longitudinal direction is defined in the right side of the fitting recess 13*b* of the recess 13*a*. A compression spring 15 is received in the recess 13*c*. A laterally extending guide 13*j* (refer to FIG. 10) engagable with the rail groove 11*d* of the base 11 is provided in the bottom side of the portion of the lower holder 13 further rearward relative to the recess 13*a*.

A rectangular projection 13*f* is defined in the right side of the recess 13*c* of the recess 13*a*. The projection 13*f* is fitted in a hole 14*e* defined on the operation plate 14 when installing the operation plate 14 in the lower holder 13. An operation plate support 13*g* is provided in the front side of the recess 13*a* of the lower holder 13 to provide support for the operating portion 14*a* of the operation plate 14 and to allow longitudinal movement of the operating portion 14*a*. A pin support portion 13*h* that supports the right end portion of the pin 17 is formed in the right side of the recess 13*a* of the lower holder 13. The support portions 13*g* and 13*h* respectively communicate with the recess 13*a*.

Figure 9:
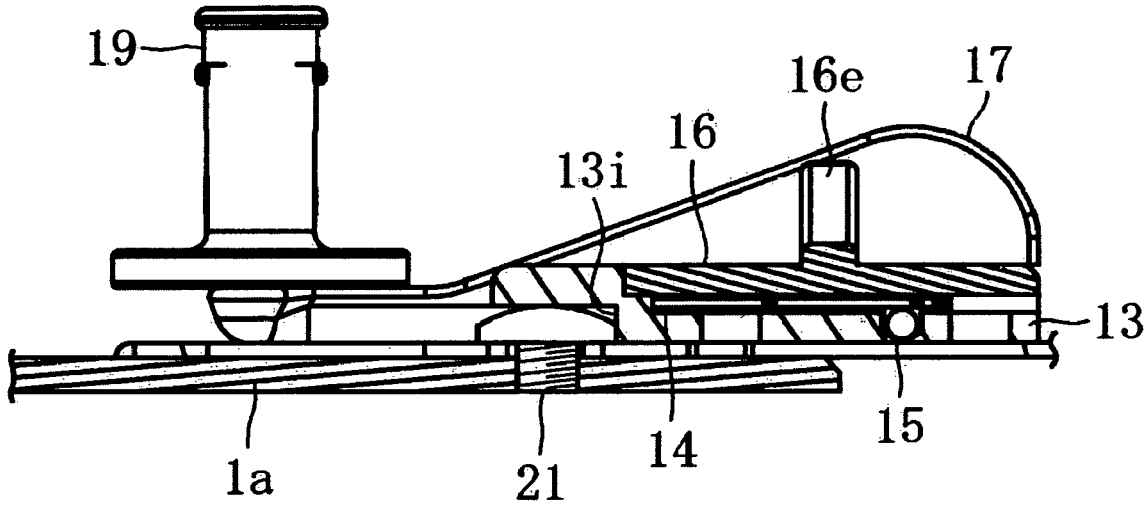
FIG. 9 is a cross-sectional view taken along line IX-IX of FIG. 8.

Referring to FIG. 9, a stopper 13*i* is formed in the bottom side of the lower holder 13. When the base 11 is attached in the second position and circular stitching radius is reduced by moving the pin support 12 in the direction (left) to proximate the needle hole 1*b* of the needle plate 1*a*, the stopper 13*i* of the lower holder 13 abuts the right side portion of the screw 21 head. The leftward movement of the pin support 12 is regulated by the stoppage of the pin support 12 effected by the screw 21. Thus, a needle clamp 22 or a needle fastening screw 23 that secure the sewing needle 7 to the needle bar 6 do not interfere with the needle 18 or the needle cap 19 mounted on the needle 18 to allow safe execution of circular stitching.

Referring to FIG. 5, the operation plate 14 is formed in substantially L-shape in plan view and includes the operating portion 14*a* extending in the longitudinal direction and an engagement subject 14*b* protruding rightward from the rear end of the operation plate 14. An engagement catch 14*c* that engages with an engagement recess 17*b* of the later described pin 17 is formed in the front end of the engagement subject 14*b*. A curvature 14*d* taking a downward curve is provided in the left side of the operating portion 14*a* of the operation plate 14. The compression spring 15 is received in the recess 13*c* with the front end of the compression spring 15 placed in abutment with the rear surface of the curvature 14*d* and the rear end placed in abutment with the rear wall of the recess 13*c*. The elasticity of the compression spring 15 forwardly biases the operation plate 14.

A rectangular hole 14*e* is defined in the rear end of the operation plate 14. The hole 14*e* receives the projection 13*f* of the lower holder 13 when installing the operation plate 14 in the lower holder 13. The longitudinal length of the hole 14*e* is defined in greater length than the longitudinal length of the projection 13*f*.

The upper holder 16 is installed in the recess 13*a* of the lower holder 13 so as to movably enclose the operation plate 14 between the upper holder 16 and the lower holder 13. A couple of catches 16*a* are formed on the front end of the upper holder 16, and a couple of catches 16*b* (only one of which are shown in FIG. 5) are formed in the rear end underside of the upper holder 16. The four catches 16*a* and 16*b* are engaged with the four engagement holes 13*d* and 13*e* of the lower holder 13. A fitting hole 16*c* for fitting the projection 17*d* of the later described pin 17 is formed in the left end of the upper holder 16. The opening edge of the fitting hole 16*c* is chamfered to facilitate fitting of the projection 17*d* of the pin 17. The fitting hole 16*c* is configured in the same size as the recess 13*b* of the lower holder 13. The fitting hole 16*c* and the fitting hole 13*b* are aligned when the upper holder 16 is installed in the lower holder 13. A rightwardly opened aperture 16*d* is defined in the right side portion of the upper holder 16. A pair of cloth sliders 16*e* in a substantially triangular form in side view is placed upright on the central portion of the upper holder 16. The pair of cloth sliders 16*e* oppose each other over a spacing corresponding to the spacing between the front and rear walls of the aperture 16*d*. Each cloth slider 16*e* is upwardly inclined toward the pin 17 so that the height of the upper surface of the cloth slider 16*e* increases toward the pin 17 and the uppermost portion of the cloth slider 16*e* is slightly lower than the uppermost portion of a tab 17*g* of the pin 17.

Figure 6:
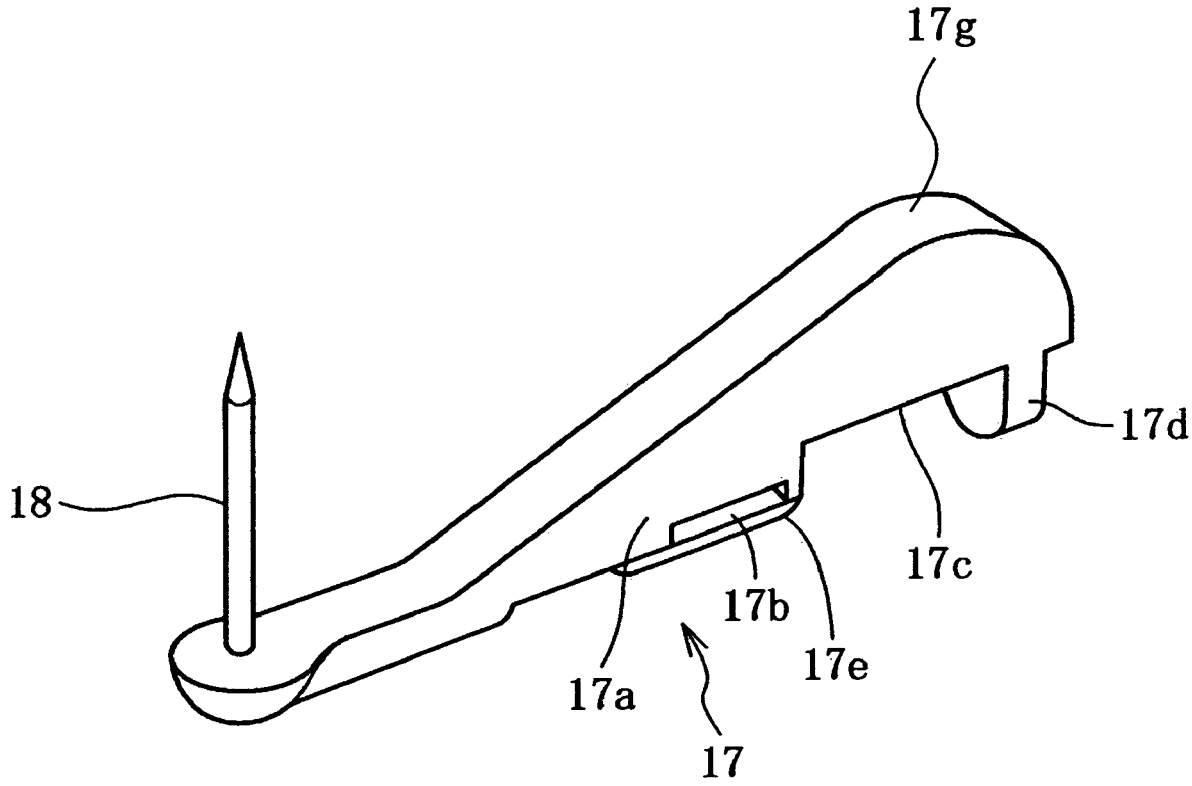
FIG. 6 is a perspective view showing a rear side of the pin.

Referring to FIGS. 5 and 6, the pin 17 includes an engagement 17*a* engagable with the engagement subject 14*b* of the pin support 12, and a needle 18 disposed so that its tip is oriented upward. The needle 18 is disposed in a position horizontally spaced by a predetermined distance from the engagement 17*a*. The predetermined distance may be configured at a distance that at least disallows interference of the collar 19*a* of the needle cap 19 with the engagement 17*a*. The diameter of the collar 19*a* of the needle cap 19 may be configured at a measurement that allows the rotating workpiece cloth to be pressed down.

Referring to FIG. 5, the right end (left end in FIG. 6) of the laterally extending pin 17 is thinned so that its height is lower than the height of the left end. Further, the right end portion of the pin 17 has a horizontal upper surface and the upper surface which is leftward relative to the right end portion exhibits a leftwardly upward slope. The needle 18 is disposed on the upper surface of the right end portion of the pin 17 so that the tip of the needle 18 is oriented upward. The bottom surface of the pin 17 is formed in a downwardly projecting curve. Thus, when the pin 17 detached from the pin support 12 is placed on a work table, for example, the distal end of the needle 18 is oriented sideways and not upward.

A notch 17*c* is defined on the left-side lower end of the pin 17 for assembling the pin 17 with the pin support 12. A projection 17*d* fitting into the fitting hole 16*c* of the upper holder 16 and the fitting recess 13*b* of the lower holder 13 is formed at the immediate left side of the notch 17*c*. Further, the longitudinal width of the pin 17 is configured so that its front and rear walls are placed in abutment with a pair of inner walls of the cloth sliders 16*e*. An engagement 17*a* is provided in the immediate right side of the notch 17*c* of the pin 17 and a chamfered surface 17*e* (refer to FIGS. 6 and 13) is formed on the rear wall of the lower end of the engagement 17*a*.

Figure 13:
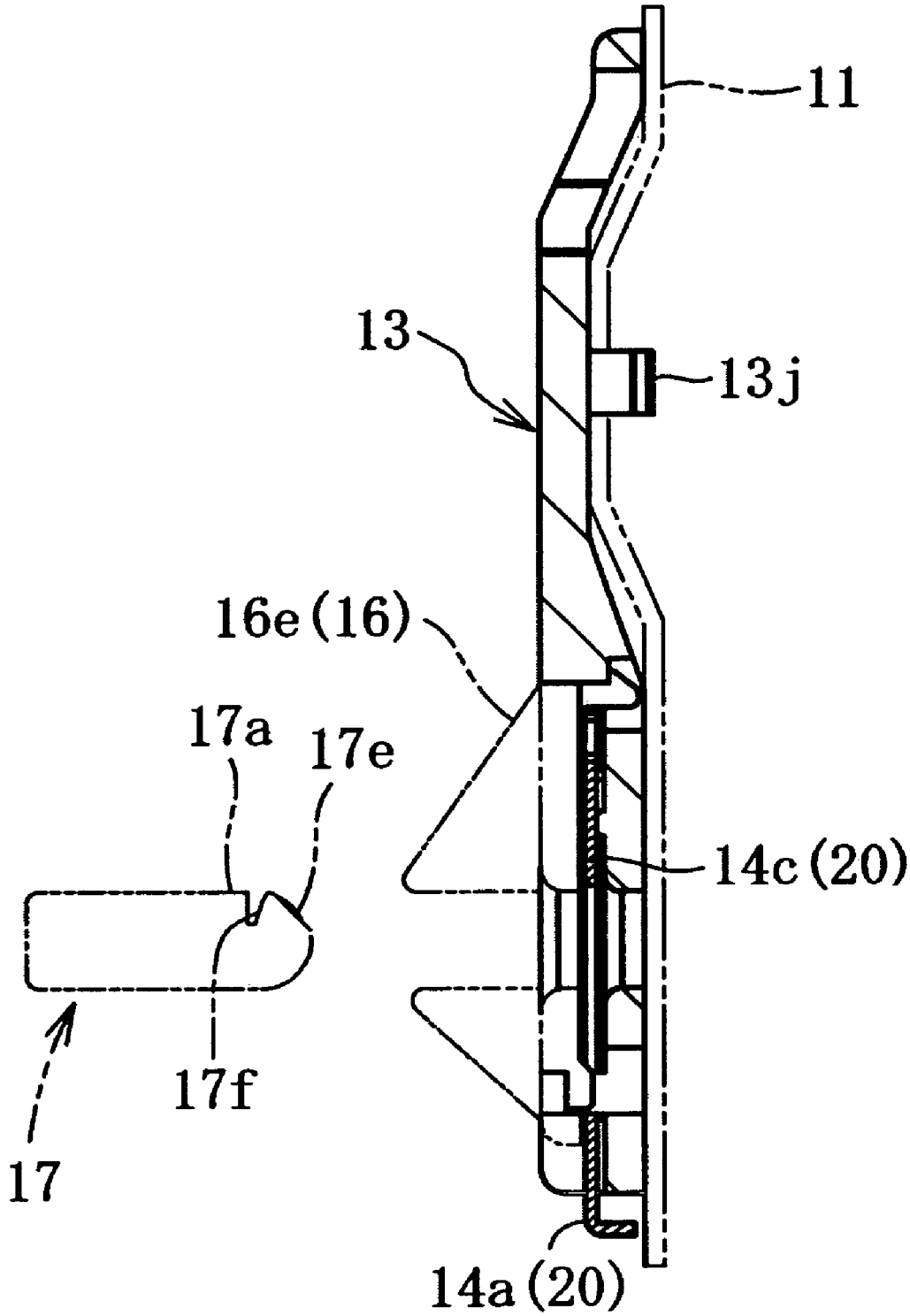
FIG. 13 is a cross-sectional view taken along line XIII-XIII of FIG. 10.

A laterally extending engagement recess 17*b* is defined in the portion immediately above the chamfered surface 17*e* and as shown in FIG. 13, a slope 17*f* is formed in the lower side of the engagement recess 17*b* interior (the lower side being the opposing side relative to the orientation of the pin 17 tip, in other words the right side in FIG. 13). The slope 17*f* exhibits an incline such that the space enclosed by the slope 17*f* and the opposing surface becomes narrower in proportion to the depth from the surface of the pin 17. When the pin 17 is assembled with the pin support 12, the engagement 17*a* is fitted with the aperture 16*d* of the upper holder 16 and the projection 17*d* is fitted with the fitting hole 16*c* of the upper holder 16 and the fitting recess 13*b* of the lower holder 13. At this instance, the notch 17*c* is placed in abutment with the upper surface of the upper holder 16. The inner walls of the pair of cloth sliders 16*e* are placed in abutment with the front and rear walls of the pin 17. The support thus given prevents the pin 17 from falling in the front and rear directions.

Also, the left end side of the pin 17 (the portion in the opposite side of the pin 18) defines a tab 17*g* having an upper end formed in a curve and higher than the cloth slider 16*e*. The tab 17*g* provides access to the user for attachment/detachment of the pin 17.

Next, a description will be given on the lock mechanism 20.

Referring to FIGS. 10 to 13, the lock mechanism 20 includes an engagement catch 14*c*, a compression spring 15 that bias the engagement catch 14*c* in the direction to establish engagement with the engagement recess 17*b*, and an operating portion 14*a* for disengaging the engagement catch 14*c* and the engagement recess 17*b*.

Figure 10:
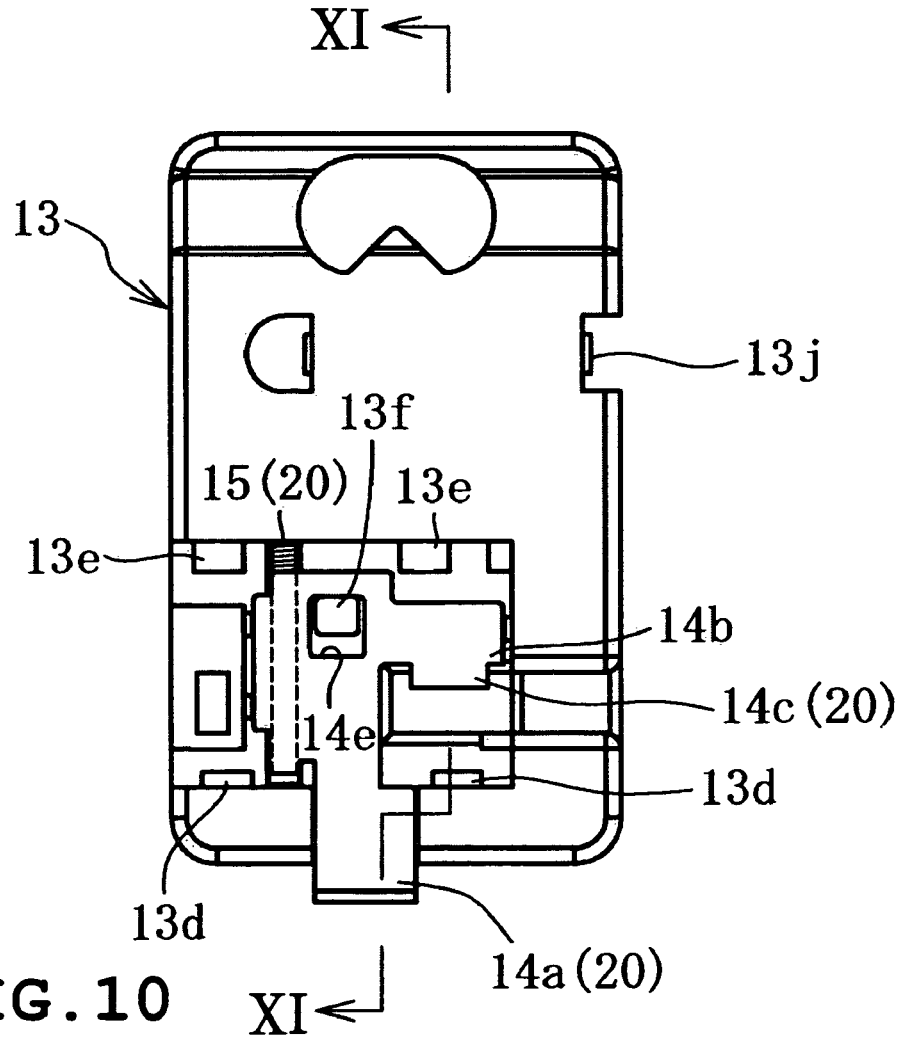
FIG. 10 is a plan view of a lock mechanism in locked state.
Figure 11:
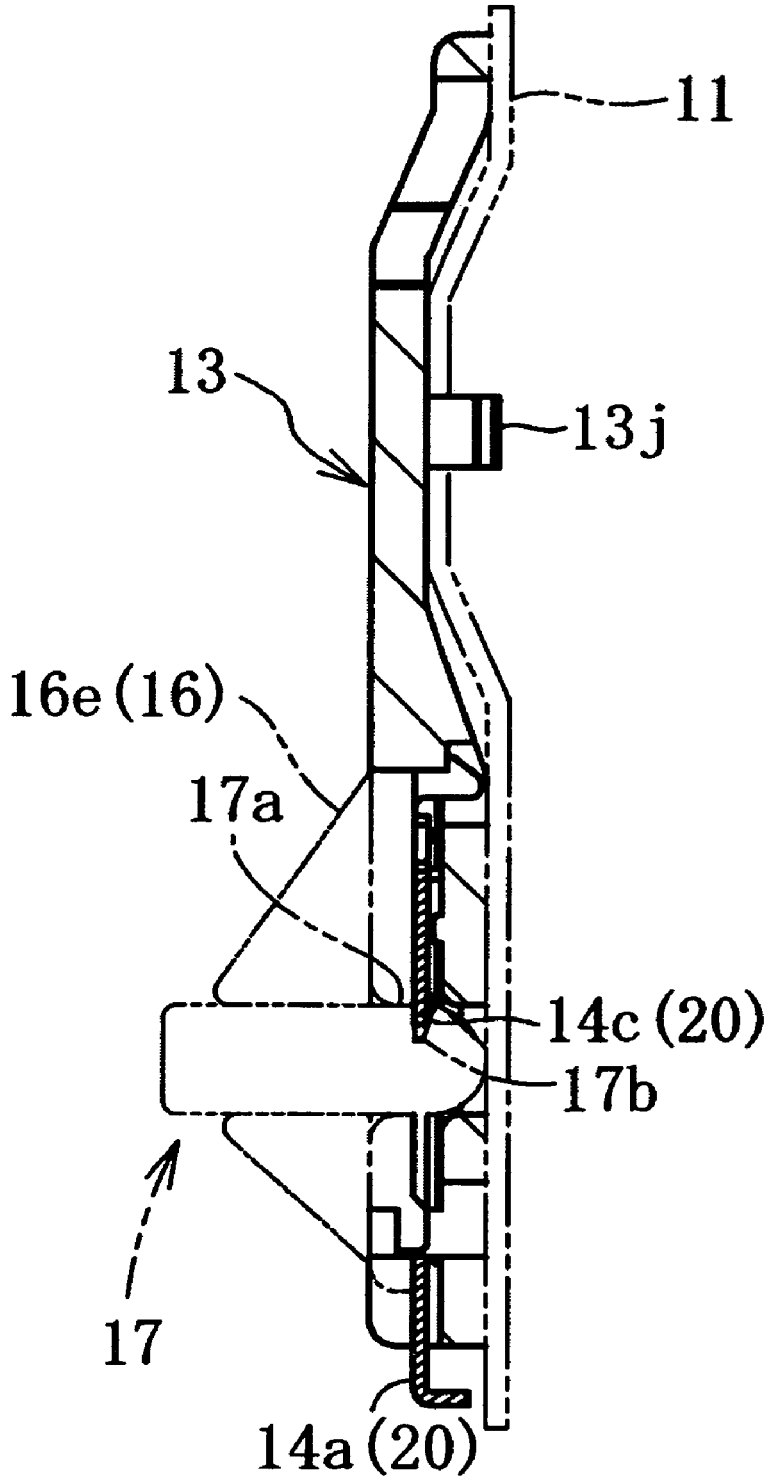
FIG. 11 is a cross-sectional view taken along line XI-XI of FIG. 10.

Referring to FIGS. 10 and 11, in attaching the pin 17 to the pin support 12, the engagement 17*a* of the pin 17 is fitted in the engagement subject 14*b* of the pin support 12 in resistance of the elasticity of the compression spring 15. At this time, the engagement catch 14*c* of the operation plate 14 is engaged with the engagement recess 17*b* of the pin 17 by the elasticity of the compression spring 15.

Figure 12:
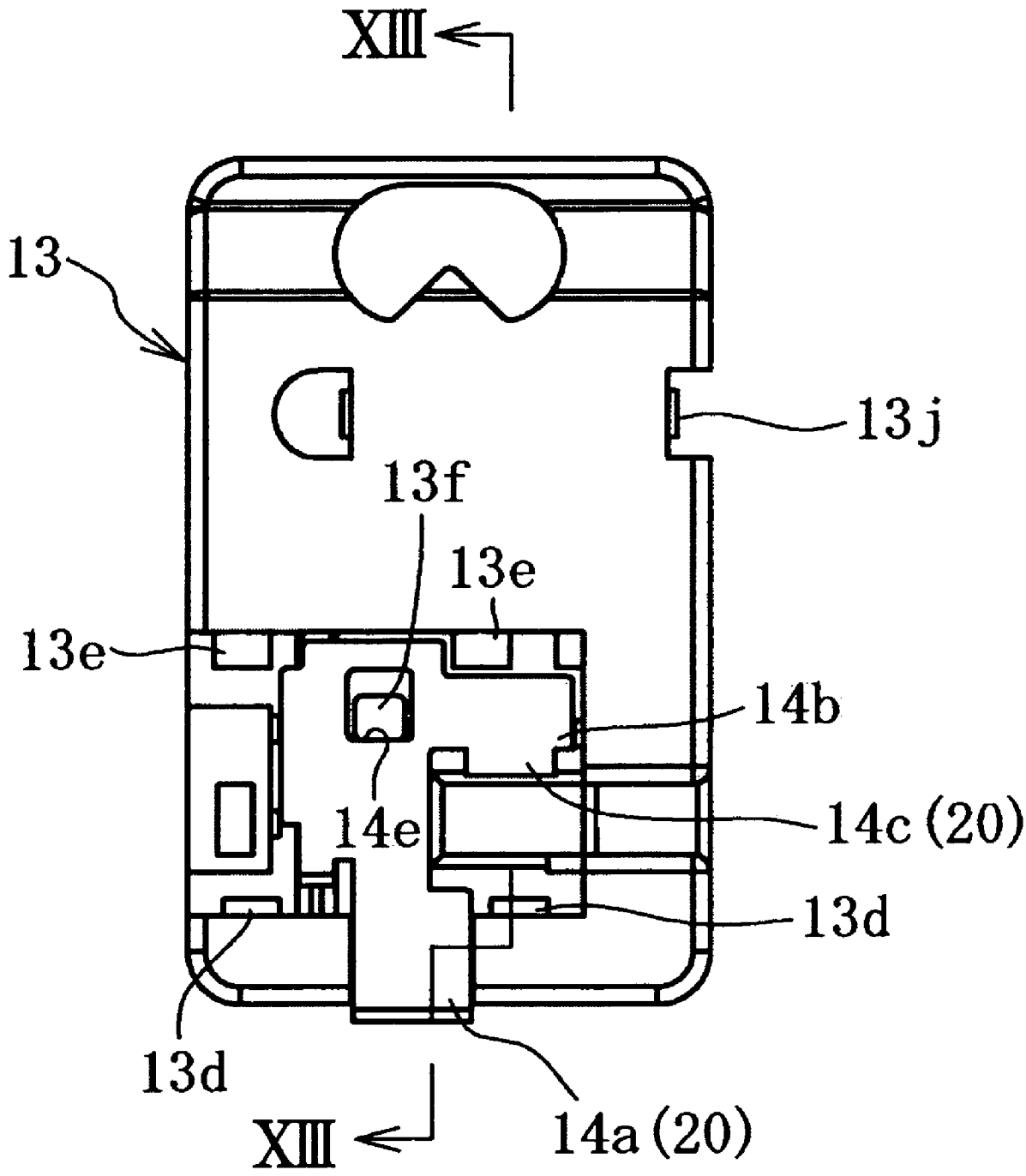
FIG. 12 is a plan view of a lock mechanism in released state.

On the other hand, as shown in FIGS. 12 and 13, the rearward movement of the operating portion 14*a* causes the rearward (the direction moving away from the engagement recess 17*b*) movement of the engagement catch 14*c* to release the engagement catch 14*c* from the engagement recess 17*b*.

Next, a description will be given on the operation and effect of the above described circular stitcher 10.

First, a description will be given on the case in which the circular stitcher 10 is attached in the first position relative to the needle plate 1*a*.

Referring to FIG. 4, the protrusion 11*g* of the base 11 is initially inserted in the through hole 1*c* of the needle plate 1*a* and the protrusion 11*h* is inserted in the through hole 1*d*. Next, the through hole 11*e* of the base 11 is aligned with the screw hole of the needle plate 1*a*. Under such state, the screw 21 is screw engaged with the needle plate 1*a* to secure the body base 11 to the needle plate 1*a* in the first position.

On the other hand, when the circular stitcher 10 is attached in the second position relative to the needle plate 1*a*, the protrusion 11*h* of the base 11 is inserted into the through hole 1*c* of the needle plate 1*a* and the protrusion 11*g* is inserted into the through hole 1*d*. Next, the insertion hole 11*f* of the base 11 is aligned with the screw hole of the needle plate 1*a*. Under such state, the screw 21 is screw engaged with the screw hole of the needle plate 1*a* to secure the body base 11 in the second position relative to the needle plate 1*a*.

When the circular stitcher 10 is attached in the first position, the pin 17 is removed from the pin support 12 by rearwardly moving the operating portion 14*a* of the operation plate 14, to move the engagement catch 14*c* of the operation plate 14 away from the engagement recess 17*b* of the pin 17. Thus, the engagement subject 14*b* of the pin support 12 is released from the engagement 17*a* of the pin 17. The pin 17 is removed from the pin support 12 under such state. Alternatively, the pin 17 may be removed prior to attaching the circular stitcher 10 on the needle plate 1*a*.

Next, the needle 18 of the pin 17 is pierced through the circular stitching center of the workpiece cloth. Then, the needle cap 19 is attached on the needle 18 pierced through the workpiece cloth. Then, the pin 17 is engaged with the pin support 12 under such state. At this time, when the engagement 17*a* of the pin 17 is fitted with the engagement subject 14*b* of the pin support 12 from above, the chamfered surface 17*e* on the lower end of the engagement 17*a* is placed in abutment with the engagement catch 14*c* to rearwardly press the engagement catch 14*c* against the elasticity of the compression spring 15. When the engagement 17*a* is further urged downward from this state, the engagement catch 14*c* of the operation plate 14 is engaged with the engagement recess 17*b* of the pin 17 and the engagement 17*a* of the pin 17 is seized by the engagement subject 14*b* of the pin support 12. At this time, since the engagement catch 14*c* is placed in abutment with the lower side slope 17*f* of the engagement recess 17*b* as described earlier, the elasticity of the compression spring 15 operates in the direction to downwardly press the slope 17*f* of the engagement recess 17*b*. Thus, the pin 17 establishes intimate contact with the pin support 12 to prevent vertical rattle of the pin 17 relative to the pin support 12.

As described above, the circular stitcher 10 includes the base 11 attachable to the upper surface of the needle plate 1*a*, the pin support 12 seized movably in the predetermined direction by the base 11 and provided with the engagement subject 14*b*, the pin 17 having the engagement 17*a* engagable with the engagement subject 14*b* of the pin support 12 and the needle 18, and a lock mechanism 20 provided in the pin support 12 and that releasably locks the engagement 17*a* with the engagement subject 14*b*. The above described configuration allows the pin 17 to be readily attached to/detached from the pin support 12. Further, the lock mechanism 20 maintains the engagement 17*a* of the pin 17 with the engagement subject 14*b* of the pin support 12. Thus, when the pin 17 is attached to the pin support 12, the rattle of the pin 17 can be eliminated.

The engagement recess 17*b* is provided on the engagement 17*a*, whereas an engagement catch 14*c* establishing engagement with the engagement recess 17*b* of the engagement 17*a* is provided on the engagement subject 14*b*. Further the lock mechanism 20 includes a compression spring 15 elastically biasing the engagement catch 14*c* in the direction to establish engagement with the engagement recess 17*b*, and an operating portion 14*a* that releases the engagement catch 14*c* from the engagement recess 17*b*. The lock mechanism 20, when establishing engagement between the engagement 17*a* and the engagement subject 14*b*, engages the engagement catch 14*c* with the engagement recess 17*b* against the elasticity of the compression spring 15. Thus, the elasticity of the compression spring 15 allows the pin 17 to be securely seized by the pin support 12.

Further, the lock mechanism 20 releases the engagement 17*a* from the engagement subject 14*b* by moving the engagement catch 14*c* away from the engagement recess 17*b* in response to the operation of the operating portion 14*a*. The engagement catch 14*c* thus disengaged from the engagement recess 17*b* allows the detachment of the pin 17 from the pin support 12 with ease.

Figure 14:
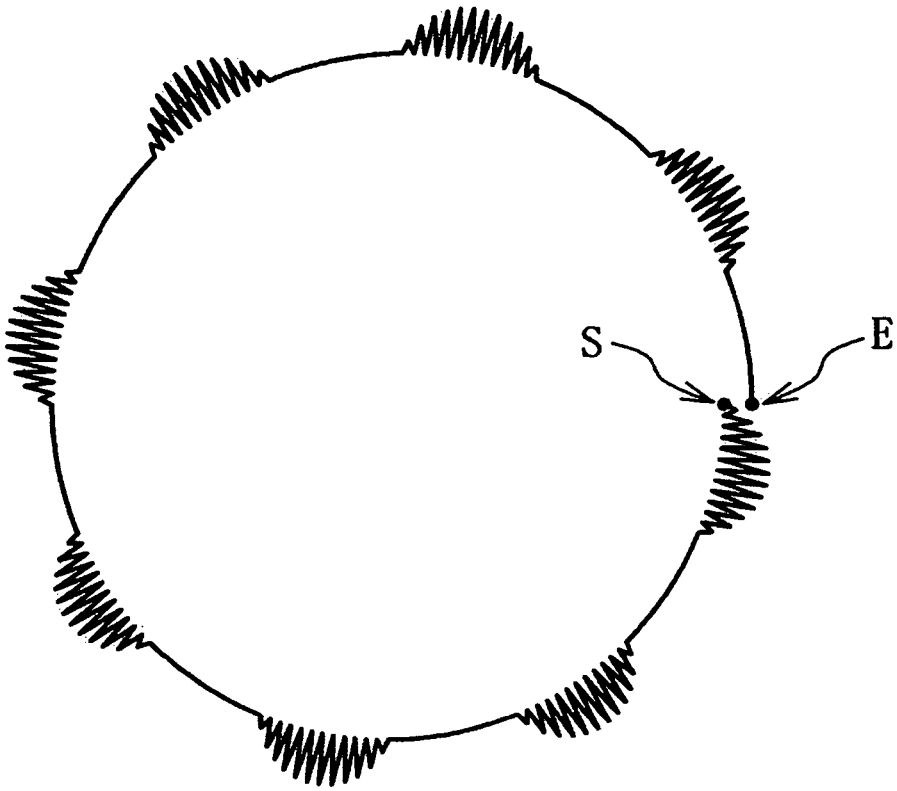
FIG. 14 shows a state where sewing start and sewing end is displaced.
Figure 15:
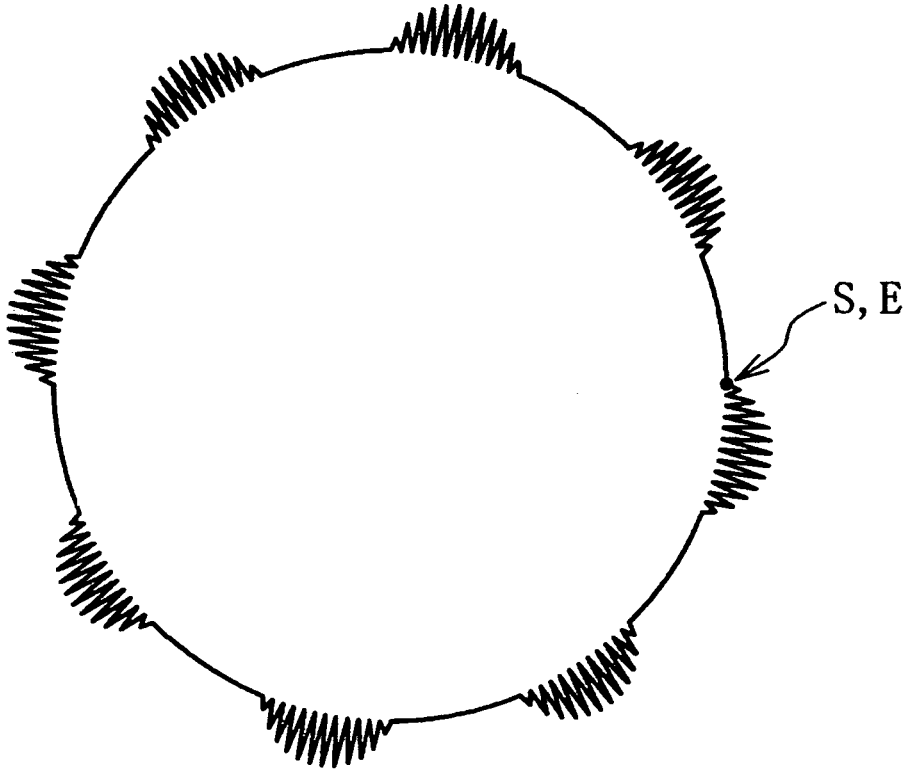
FIG. 15 shows a proper stitching result where no displacement occurs between sewing start and sewing end.

The engagement 17*a* and the needle 18 are disposed on the pin 17 with a predetermined spacing therebetween. Thus, the height of the needle 18 can be lowered independent of the height of the engagement 17*a*. The lowering of elevation of the needle 18 allows reduction in height difference between the needle plate 1*a* upper surface on which the workpiece is placed and the upper surface of the base end of the needle 18. The distance between the presser foot 4 (refer to FIG. 2) for pressing the workpiece cloth against the upper surface of the needle plate 1*a* and the needle 18 becomes closer together especially when executing small-radius circular stitching. However, the reduction in height difference between the needle plate 1*a* upper surface and the upper surface of the base end of the needle 18 described above, minimizes formation of steps on the workpiece cloth originating from such difference in height. When sizable steps occur on the workpiece cloth, the workpiece cloth exhibits a curved profile. When the workpiece cloth is sewn under such state, the alignment of point S indicative of start point and point E indicative of end point of circular stitch pattern become displaced as shown in FIG. 14. The present exemplary embodiment minimizes the size of the steps to allow the workpiece cloth with hardly any curves. As a result, no displacement in the start point S and the end point E of circular stitch pattern is observed as shown in FIG. 15, and the position of sewing start and sewing end can be neatly aligned.

Further, the bottom surface of the pin 17 is formed in a curved downward projection. Such form causes the pin 17 to roll over so that tip of the needle 18 is oriented sideways when the pin 17 is removed from the pin support 12 and placed on a work table, for example, to improve user safety.

The slope 17*f* formed in the lower side of the engagement recess 17*b* is affected by the elasticity of the compression spring 15 whereby the pin 17 is downwardly pressed relative to the pin support 12. Thus, when the pin 17 is attached to the pin support 12, vertical rattle of the pin 17 relative to the pin support 12 can be eliminated. It is sufficient to provide the slope 17*f* at least on the lower side of the engagement recess 17*b*.

The screw 21 is provided to secure the base 11 on the upper surface of the needle plate 1*a*. Further, the base 11 is configured to allow selective attachment in the first position and the second position. When the base 11 is attached in the second position, the screw 21 regulates the movement of the pin support 12 to the needle hole 1*d* side. Hence, even when the radius of circular stitching is reduced by moving the pin support 12 to the needle hole 1*b* side, the pin support 12 is prevented from moving to a position where the needle 18 interferes with the needle clamp 22 or the needle fastening screw 23 securing the sewing needle 7 to the needle bar 6. Thus, the needle 18 can be reliably prevented from interfering with the needle clamp 22 or the needle fastening screw 23 to allow safe execution of circular stitching.

The pin 17 has a tab 17*g* in the opposite side of the needle 18 with the engagement 17*a* disposed between the tab 17*g* and the needle 18. Thus, the user is allowed to attach/detach the pin 17 by holding the tab 17*g*, thereby eliminating the risk of the user contacting the needle 18 of the pin 17 and providing improved user safety.

The cloth slider 16*e* is provided on the pin support 12. The cloth slider 16*e* is upwardly inclined towards the pin support 12 so that the height of its upper surface increases towards the pin support 12. Thus, the workpiece cloth rotates with the guidance of the cloth slider 16*e* and the workpiece cloth is fed in a smoother fashion. The cloth slider 16*e* may also be utilized as a handle for laterally moving the pin support 12.

A second exemplary embodiment of the circular stitcher 30 will be described based on FIGS. 16 to 26.

Figure 16:
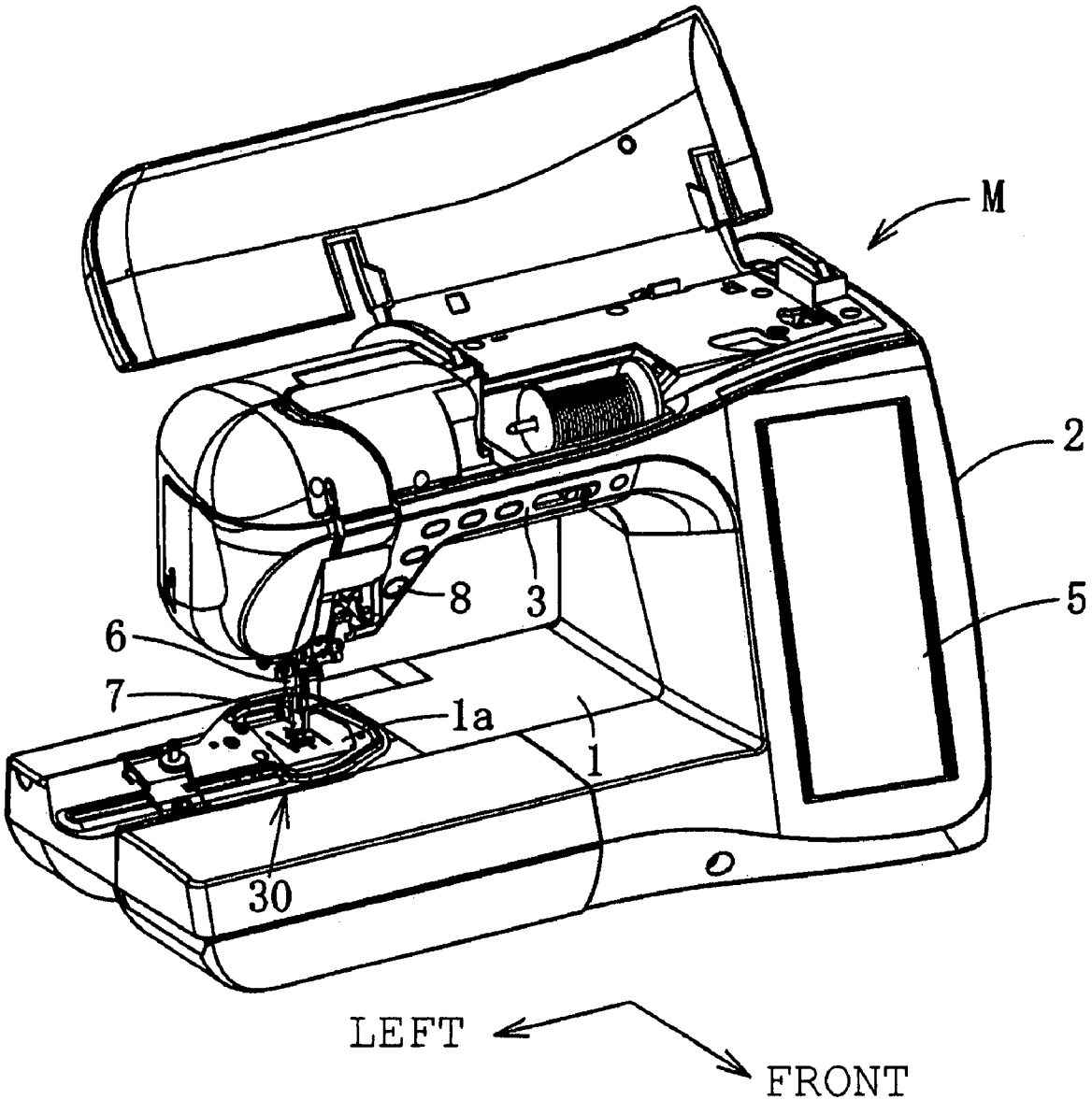
FIG. 16 illustrates a second exemplary embodiment and corresponds to FIG. 1.

The circular stitcher 30 differs from the first exemplary embodiment in that the base 31 takes a different shape, and the structure of the pin 37 is simplified, consequently modifying the structure of the lock mechanism. FIG. 16 illustrates a perspective view of an electronic sewing machine M with a circular stitcher 30 attached to it.

Figure 17:
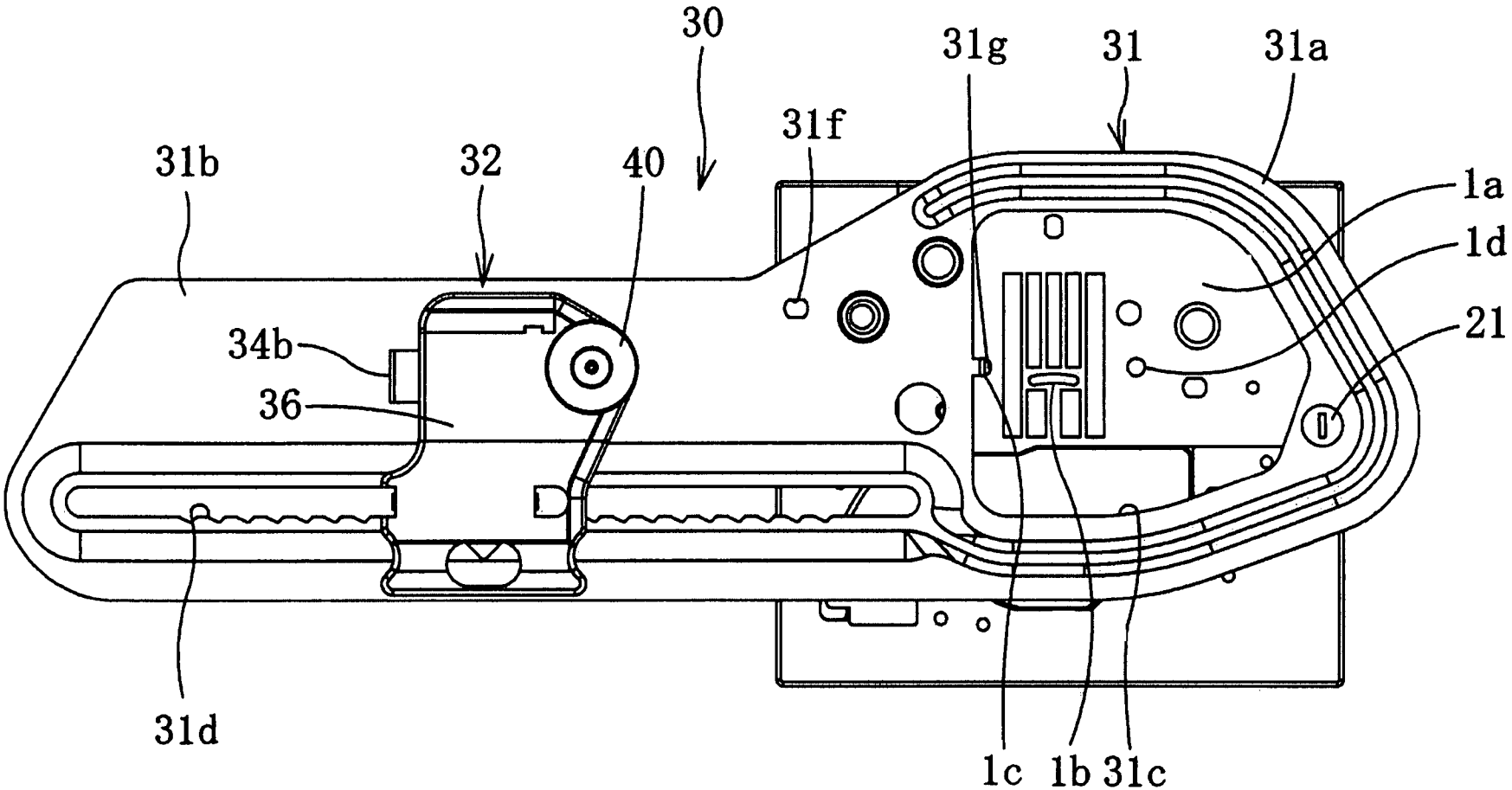
FIG. 17 corresponds to FIG. 4.

Referring to FIG. 17, the circular stitcher 30 includes a base 31 attachable on the upper surface of the needle plate 1*a*, a pin support 32 seized by the base 31 so as to be movable in a predetermined direction (lateral direction) relative to the base 31, a pin 37 (refer to FIG. 18) attachable to/detachable from the pin support 32, a lock mechanism 42 (refer to FIG. 23) securing the pin 37 on the pin support 32, and a needle cap 40 fitted over a needle 39 (refer to FIG. 18) of the pin 37 pierced through the workpiece cloth from the workpiece cloth underside. The needle cap 40 is made of flexible synthetic resin, which elasticity secures the needle cap 40 on the needle 39.

The base 31 includes an attachment 31*a* in a generally D-shape in plan view, and a linear guide 31*b* extending from the attachment 31*a*. A hole 31*c* in a generally D-shape in plan view is defined in the inner periphery of the attachment 31*a*. A linear rail groove 31*d* that guides the lateral movement of the pin support 32 is defined in the front half of the guide 31*b*.

As described in the first exemplary embodiment, a generally V-shaped groove is defined on one inner-periphery of the rail groove 11*d* for seizing the pin support 32 by elastic engagement with the pin support 32. The groove is defined at predetermined intervals (approximately 5 mm, for example) allowing adjustment of circular stitching radius in the unit of 5 mm.

Figure 20:
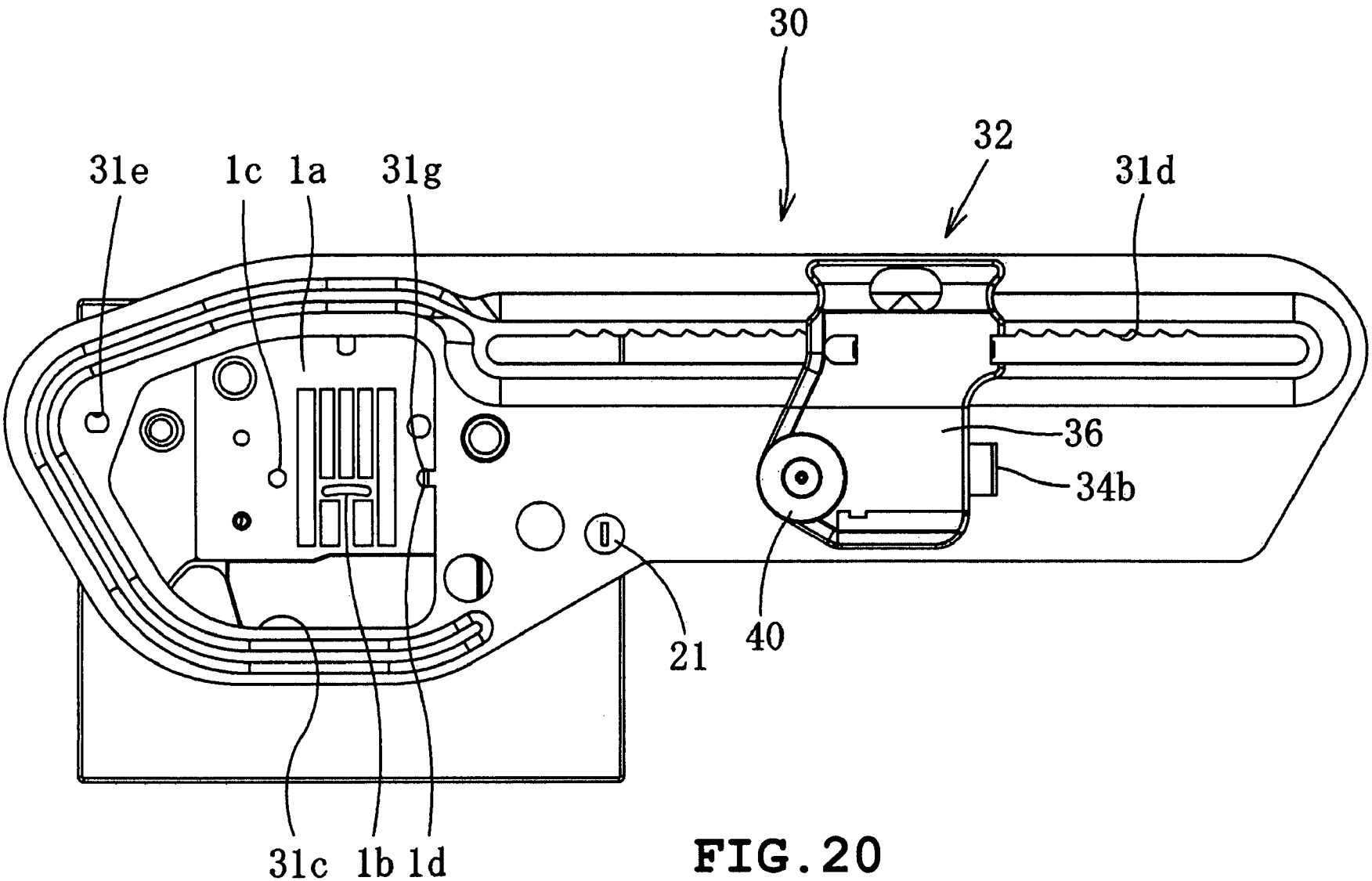
FIG. 20 corresponds to FIG. 7.

Referring to FIGS. 17 and 20, insertion holes 31*e* and 31*f* are formed in the right end proximity of the attachment 31*a* and the right end proximity of the guide 31*b*. The insertion holes 31*e* and 31*f* receive the screw 21 when securing the base 31 on the needle plate 1*a*. When attaching the base 31 in the first position shown in FIG. 17, the screw 21 is inserted in the insertion hole 31*e*; whereas when attaching the base 31 in the second position shown in FIG. 20, the screw 21 is inserted in the insertion hole 31*f*. In either case, the base 31 is secured on the needle plate 1*a* by screw engagement of the screw 21 with the screw hole (not shown) provided in the needle plate 1*a*. A protrusion 31*g* for positioning of the base 31 upon attachment of the base 31 to the needle plate 1*a* is provided on the peripheral edge of the hole 31*c*. More specifically, the protrusion 31*g* is located on the section of the inner peripheral edge of the hole 31*c* from which the guide 31*b* extends. The protrusion 31*g* is inserted to either of the through holes 31*c* or 31*d* provided in the needle plate 1*a*. The attachment position (attachment disposition) of the base 31 is thus determined.

Next, a description will be given on the pin support 32.

Figure 18:
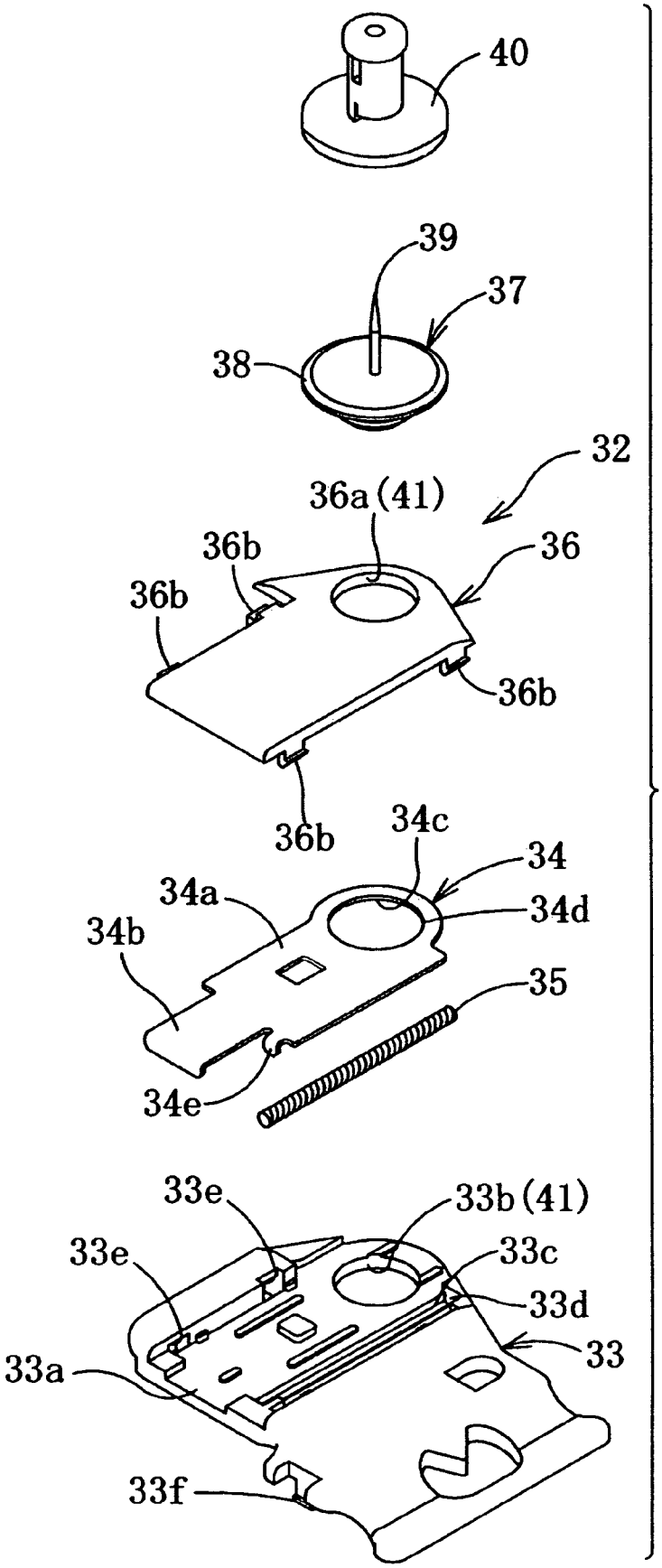
FIG. 18 corresponds to FIG. 5.

Referring to FIG. 18, the pin support 32 includes a lower holder 33, an operation plate 34, an upper holder 36, and a compression spring 35. The pin support 32 is also provided with a lock mechanism 42 (refer to FIG. 23) locking/releasing the engagement 38 to/from the engagement subject 41.

Next, a description will be given on the lower holder 33.

A recess 33*a* for receiving the operation plate 34 and the upper holder 36 is defined in the rear half of the lower holder 33 top surface. A circular hole 33*b* is defined in the right end portion of the recess 33*a*, and the diameter of the hole 33*b* is configured slightly larger than the diameter of a cylindrical portion 38*c* (refer to FIG. 19) of the pin 37. A laterally elongate recess 33*c* is formed in the front end of the recess 33*a* and the recess 33*c* accommodates the compression spring 35. Four engagement holes 33*e* for receiving four catches 36*b* of the upper holder 36 are formed on the front and rear walls of the recess 33*a*. A laterally extending guide 33*f* engagable with the rail groove 31*d* of the base 31 is formed in the bottom side of the lower holder 33, more specifically, in the portion forward relative to the recess 33*c*.

The operation plate 34 includes a body 34*a*, an operating portion 34*b* extending leftward from the left end of the body 34*a*. The operating portion 34 is received by the recess 33*a* of the lower holder 33 so as to be movable in the lateral direction. A circular hole 34*c* is defined in the body 34*a* and the diameter of the hole 34*c* is configured slightly greater than the diameter of the hole 33*b* of the lower holder 33. The right side section of the peripheral edge of the hole 34*c* serves as an engagement catch 34*d* that engages with an engagement recess 38*a* (FIG. 19) of the later described pin 37.

A curvature 34*e* which exhibits a downward curve is provided in the front side of the operating portion 34*b* of the operation plate 34. The compression spring 35 is received by the recess 33*c* of the lower holder 33 with its left end placed in abutment with the right face of the curvature 34*e*, and its right end placed in abutment with the right wall 33*d* of the recess 33*c* of the lower holder 33. The elasticity of the compression spring 35 leftwardly biases the operation plate 14.

The upper holder 36 is installed in the recess 33*a* of the lower holder 33 so as to enclose the operation plate 34 laterally movably between the upper holder 36 and the lower holder 33. A circular hole 36*a* is defined in the right end of the upper holder 36. The hole 36*a* is aligned with the hole 33*b* of the lower holder 33 when the upper holder 36 is attached to the lower holder 33. Further, the hole 36*a* and the hole 33*b* are configured in equal diameters. Four engagement catches 36*b* for engagement with the four engagement holes 33*e* of the lower holder 33 are provided in the front and rear ends of the upper holder 36.

Figure 19:
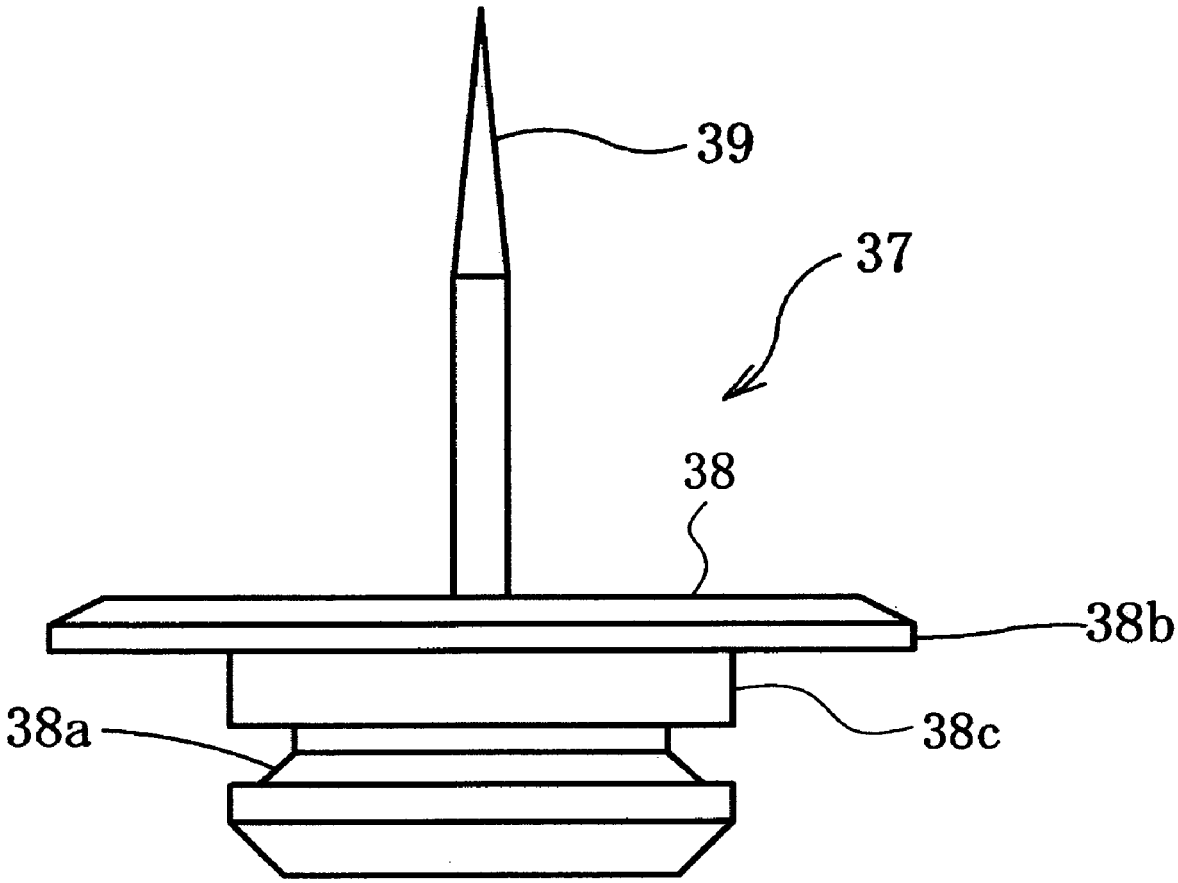
FIG. 19 is a side view of the pin.

Referring to FIGS. 18 and 19, the pin 37 includes an engagement 38 engagable with an engagement subject 41 of the pin support 32, and a needle 39 secured on the engagement 38 disposed so that its tip is oriented upward. The engagement 38 has a cylindrical portion 38*c* engagable with the holes 33*b* and 36*a* of the engagement subject 41. A collar 38*b* is provided on the upper end of the cylindrical portion 38*c* of the engagement 38 and the underside of the collar 38*b* is placed in abutment with the upper surface of the peripheral edge of the hole 36*a* formed on the upper holder 36. In the mid section (cylindrical portion 38*c*) of the engagement 38, an engagement recess 38*a* in the form of a groove is defined along the entire periphery of the side surface of the cylindrical portion 38*c* and the engagement catch 34*d* is engaged with the engagement recess 38*a*. A tapered slope having an increasing diameter toward the bottom of the slope is formed in the lower side (lower wall surface of the groove) of the engagement recess 38*a*. The lower end of the engagement 38 is chamfered.

Figure 21:
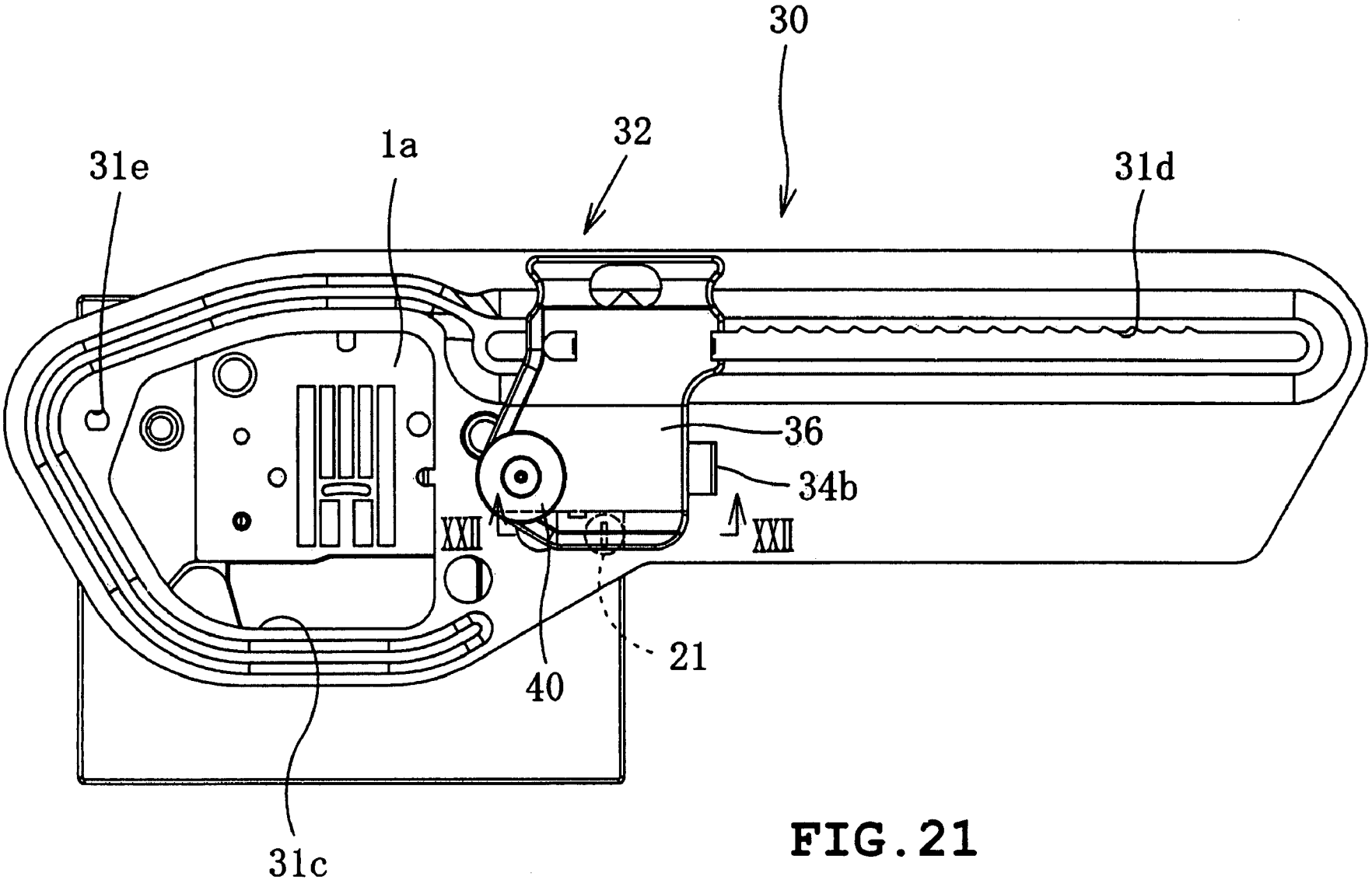
FIG. 21 corresponds to FIG. 8.
Figure 22:
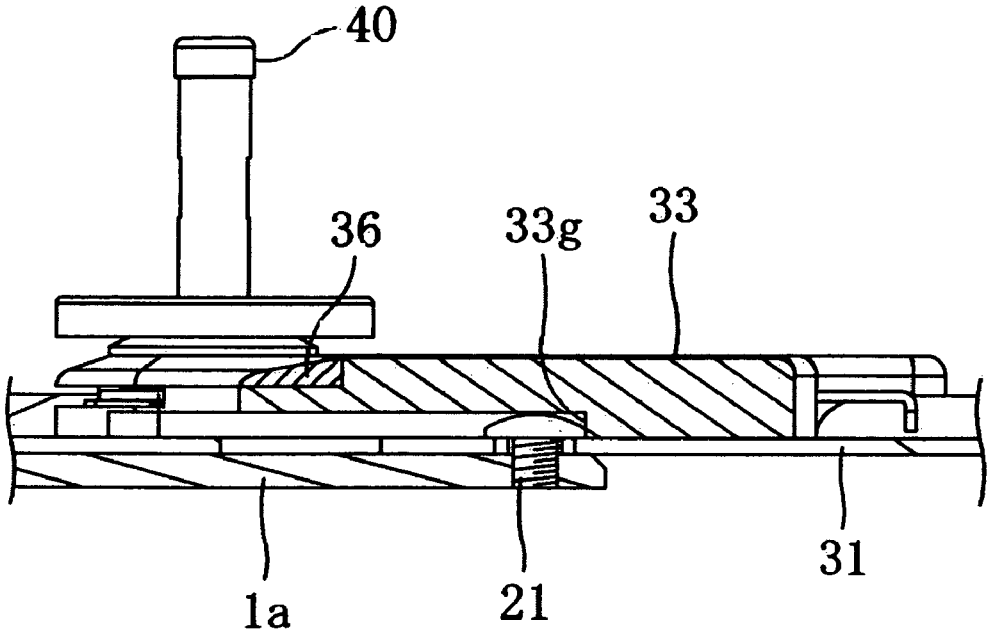
FIG. 22 is a cross-sectional view taken along line XXII-XXII of FIG. 21.

Referring to FIGS. 21 and 22, a stopper 33*g* is formed on the bottom side of the lower holder 33. When the base 31 is attached in the second position and circular stitching radius is reduced by moving the pin support 32 in the direction (left) to approach the needle hole 1*b* of the needle plate 1*a*, the stopper 33*g* of the lower holder 33 abuts the right side portion of the screw 21 head. The leftward movement of the pin support 32 is regulated by the stoppage of the pin support 32 by the screw 21. Thus, the needle clamp 22 or the needle fastening screw 23 that secures the sewing needle 7 to the needle bar 6 does not interfere with the needle 39 or the needle cap 40 mounted on the needle 39 to allow safe execution of circular stitching.

Next, a description will be given on the lock mechanism 42.

Referring to FIGS. 23 to 26, the lock mechanism 42 includes an engagement recess 38*a* provided in the engagement 38, an engagement catch 34*d* engagable with the engagement recess 38*a*, a compression spring 35 that bias the engagement catch 34*d* in the direction to establish engagement with the engagement recess 38*a*, and an operating portion 34*b* for disengaging the engagement catch 34*d* from the engagement recess 38*a*.

Figure 23:
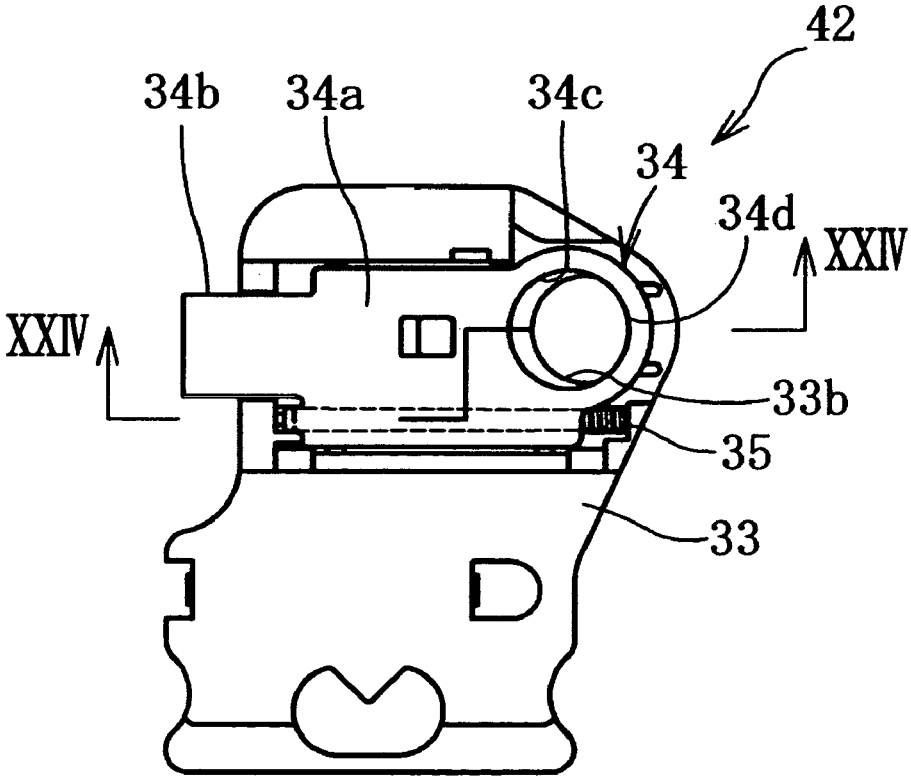
FIG. 23 corresponds to FIG. 10.
Figure 24:
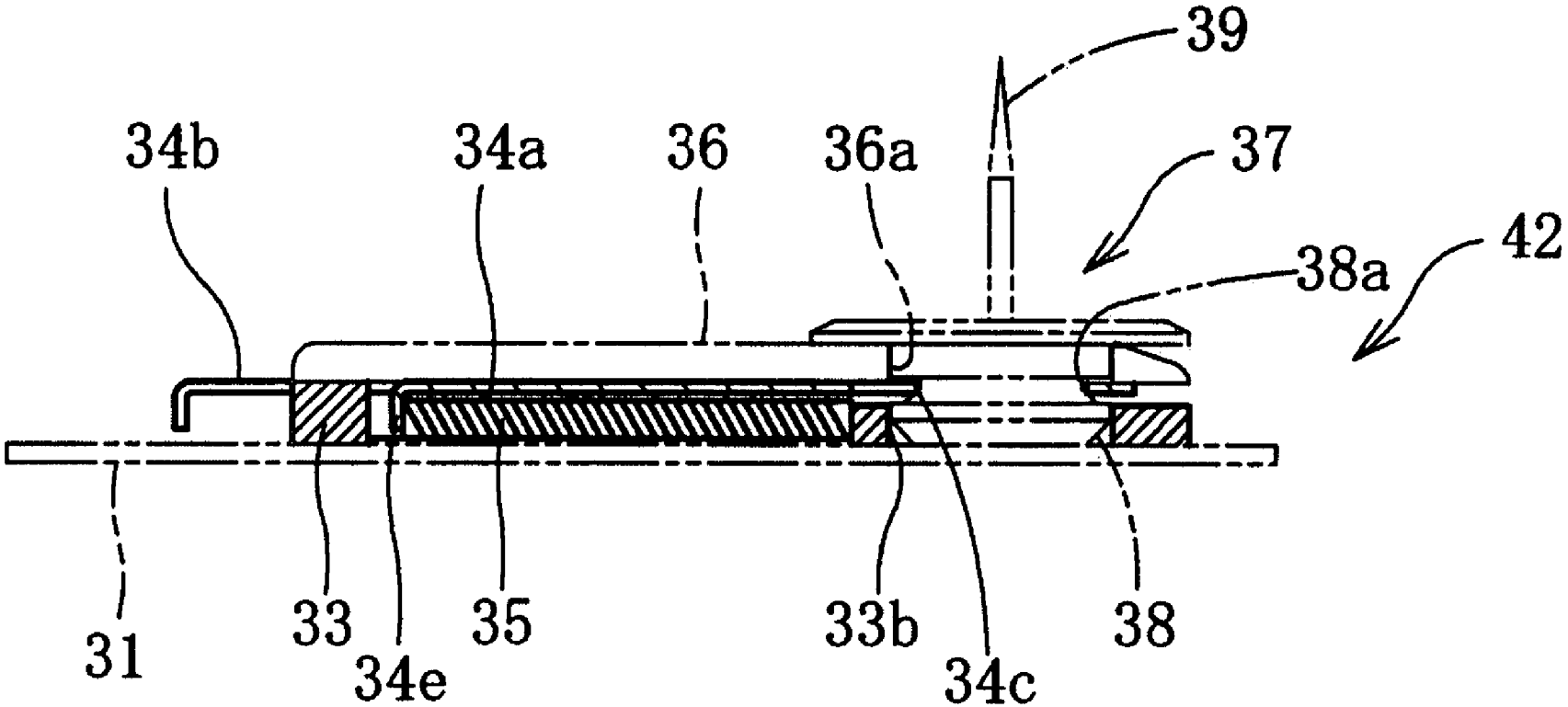
FIG. 24 is a cross-sectional view taken along line XXIV-XXIV of FIG. 23.

Referring to FIGS. 23 and 24, in attaching the pin 37 to the pin support 32, the engagement 38 of the pin 37 is fitted in the engagement subject 41 of the pin support 32 against the elasticity of the compression spring 35. At this time, the engagement catch 34*d* of the operation plate 34 is engaged with the engagement recess 38*a* of the pin 37 by the elasticity of the compression spring 35. Under such state, the engagement catch 34*d* of the engagement recess 38*a* is placed in abutment with the lower tapered slope of the engagement recess 38*a* as shown in FIG. 24. Thus, the elasticity of the compression spring 35 operates in the direction to downwardly press the slope of the engagement recess 38*a*. Thus, the pin 37 is attached to the pin support 32 with the collar 38*b* of the engagement 38 pressing the upper surface of the peripheral edge of the hole 36*a* defined on the upper holder 36.

Figure 25:
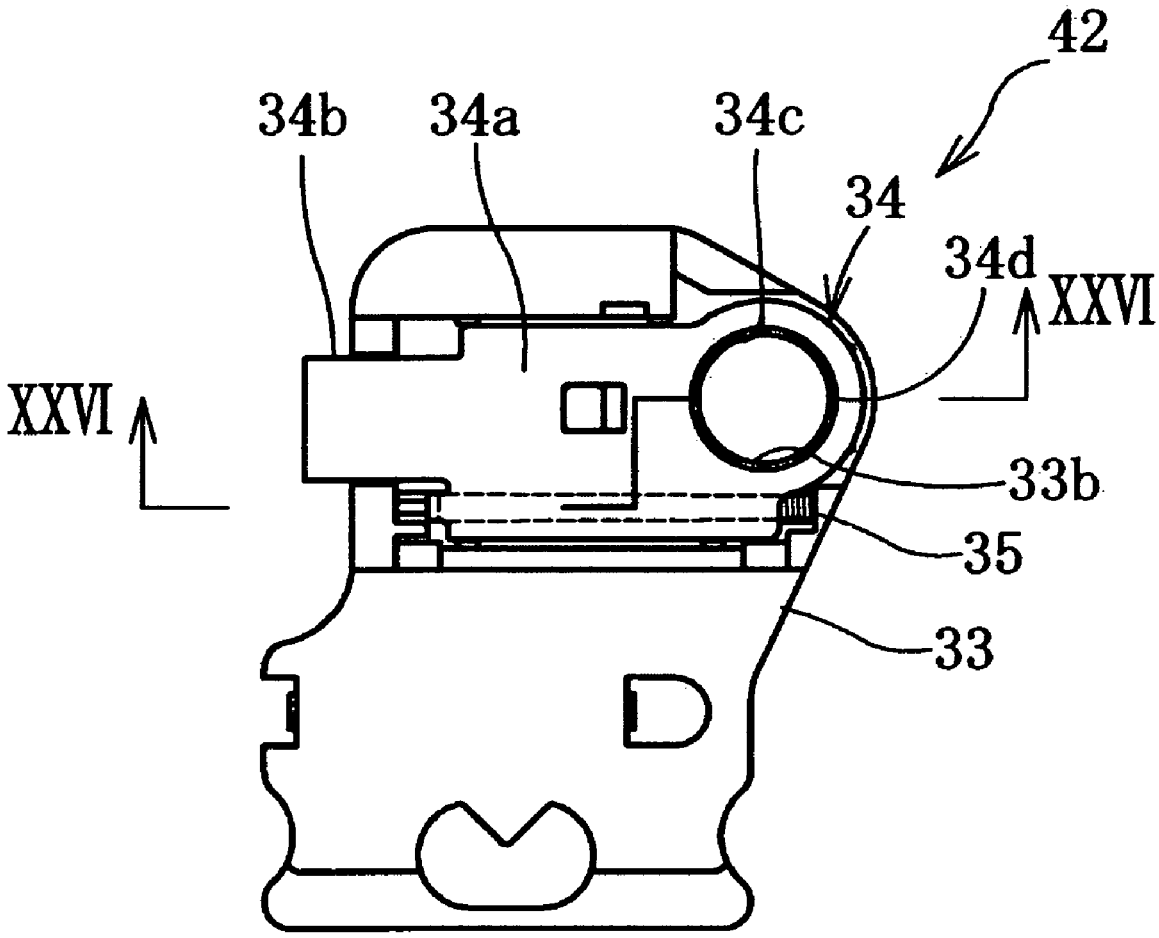
FIG. 25 corresponds to FIG. 12.
Figure 26:
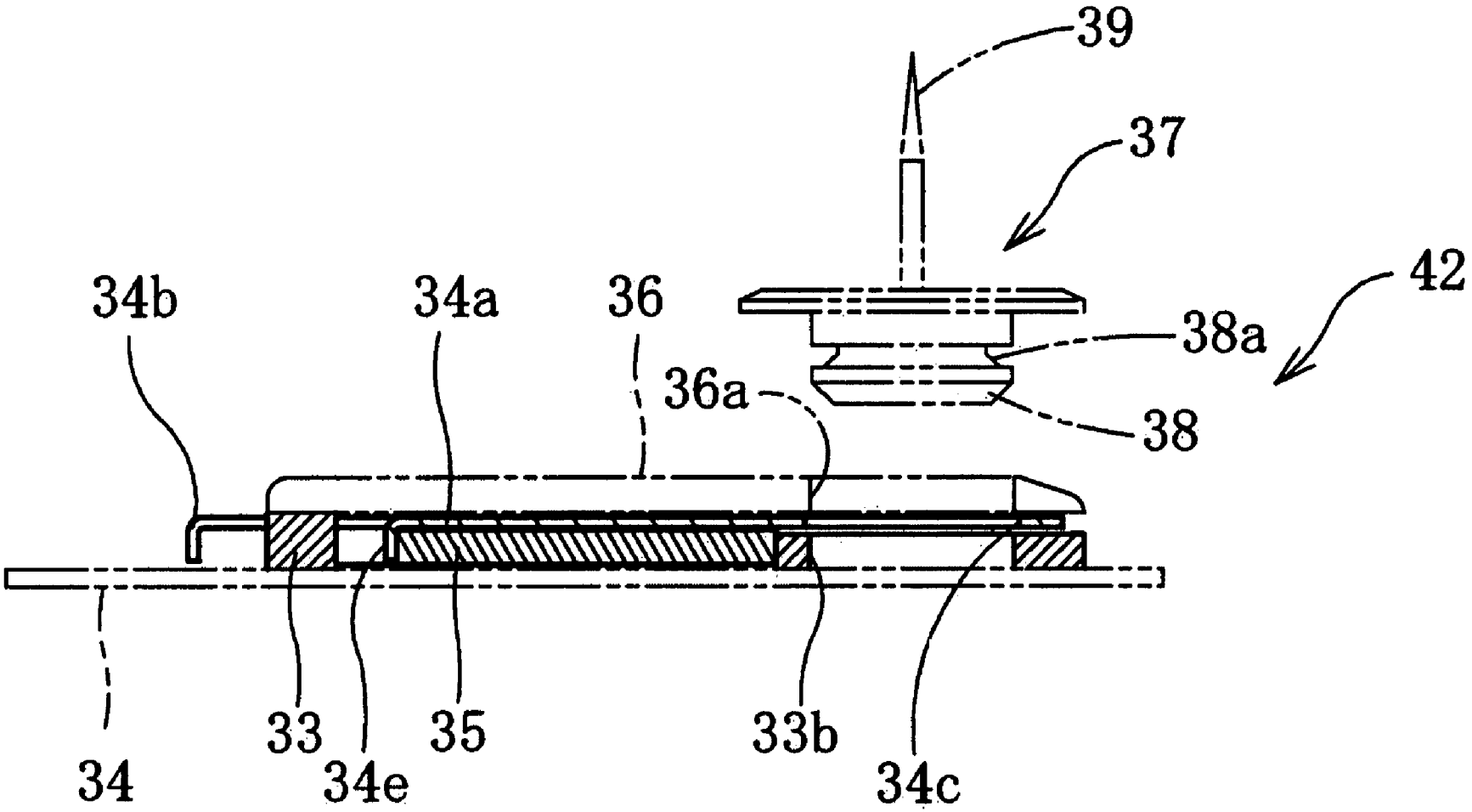
FIG. 26 is a cross-sectional view taken along line XXVI-XXVI of FIG. 25.

On the other hand, as shown in FIGS. 25 and 26, the rightward movement of the operating portion 34*b* causes the rightward (the direction moving away from the engagement recess 38*a*) movement of the engagement catch 34*d*. Thus, the engagement catch 34*d* is disengaged from the engagement recess 38*a*.

As described above, the circular stitcher 30 of the present exemplary embodiment also provides the operation and effect provided in the first exemplary embodiment.

Next, the circular stitcher 50 according to the third exemplary embodiment of the present disclosure will be described based on FIGS. 27 to 31.

The circular stitcher 50 differs from the foregoing exemplary embodiments in that the structure of the pin 54 and the lock mechanism is more simplified.

Figure 27:
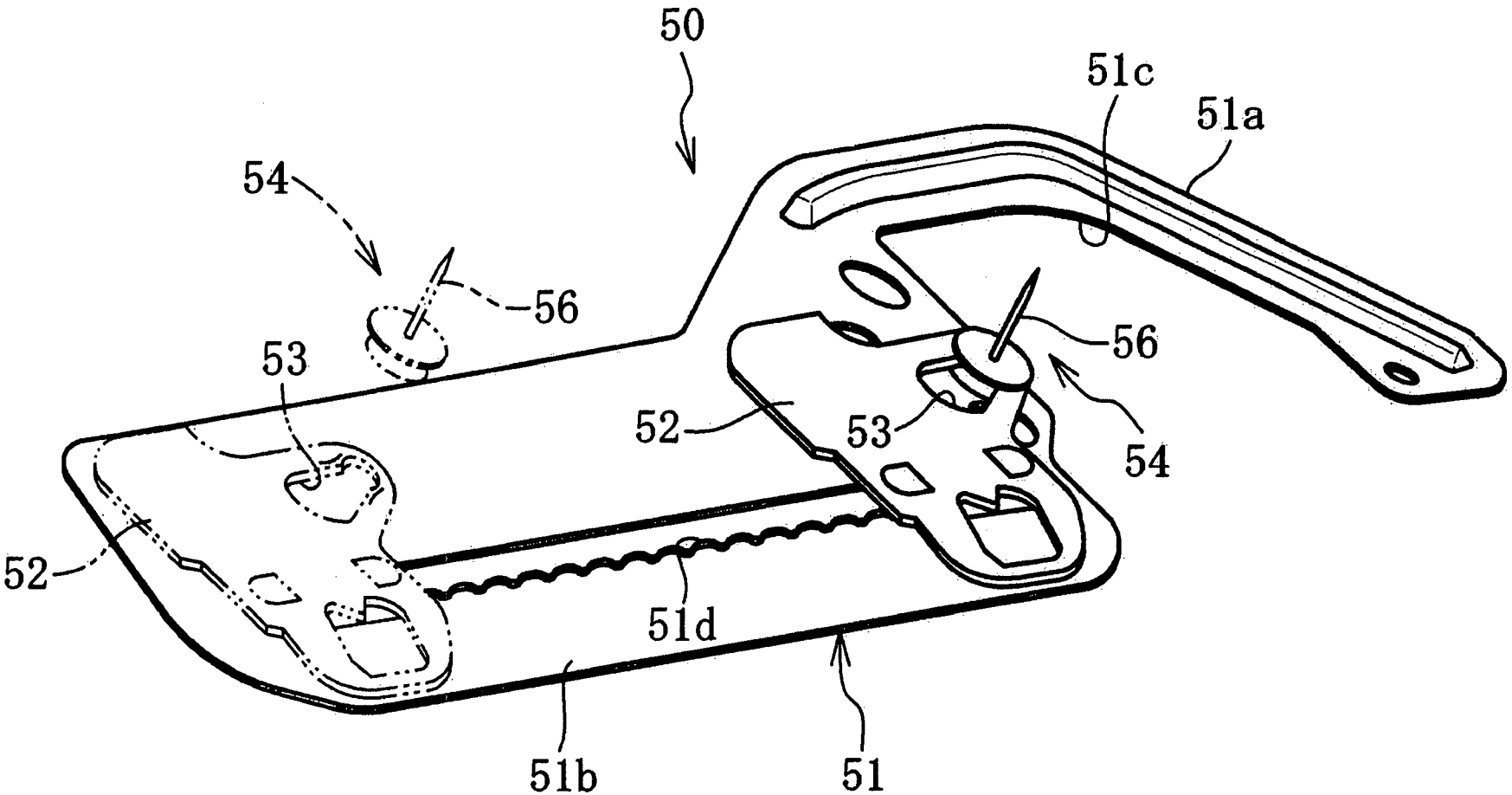
FIG. 27 is a perspective view of the circular stitcher according to a third exemplary embodiment of the present disclosure.

Referring to FIG. 27, the circular stitcher 50 includes a base 51 attachable on the upper surface of the needle plate 1*a*, a pin support 52 seized movably in a predetermined direction (lateral direction) relative to the base 51, a pin 54 attachable to/detachable from the pin support 52, a lock portion 58 (refer to FIG. 31) securing the pin 54 on the pin support 52, and a needle cap (not shown) fitted over a needle 56 of the pin 54 pierced through the workpiece from the workpiece underside.

The base 51 includes an attachment 51*a* which establishes attachment with the needle plate 1*a*, and a linear guide 51*b* extending from the attachment 51*a*. The base 51 is configured to be selectively attachable to the first position and the second position shown in the second exemplary embodiment. An aperture 51*c* opened in the forward direction is defined on the attachment 51*a*. A linear rail groove 51*d* is defined in the front half portion of the guide 51*b* to provide guidance in laterally moving the pin support 52. A substantially V-shaped groove is defined on one inner-periphery of the rail groove 51*d* for seizing the pin support 52 by elastic engagement with the pin support 52. The groove is defined at predetermined intervals (approximately 5 mm, for example) which allows adjustment of circular stitching radius in the unit of 5 mm.

Next a description will be given on the pin support 52.

Figure 29:
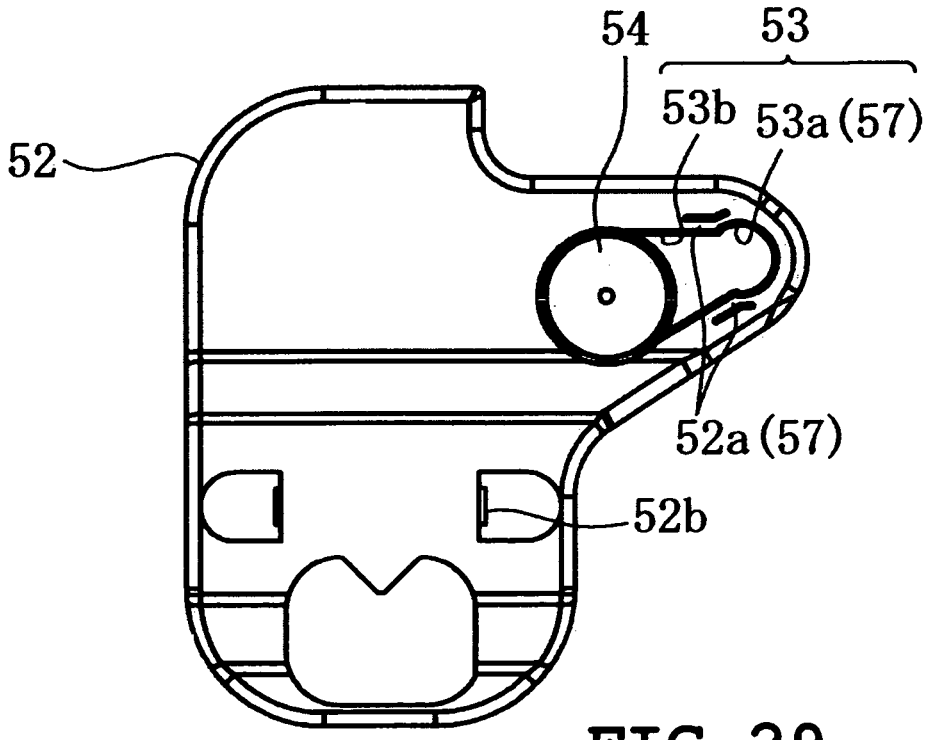
FIG. 29 is a plan view illustrating a lock portion in released state.
Figure 30:
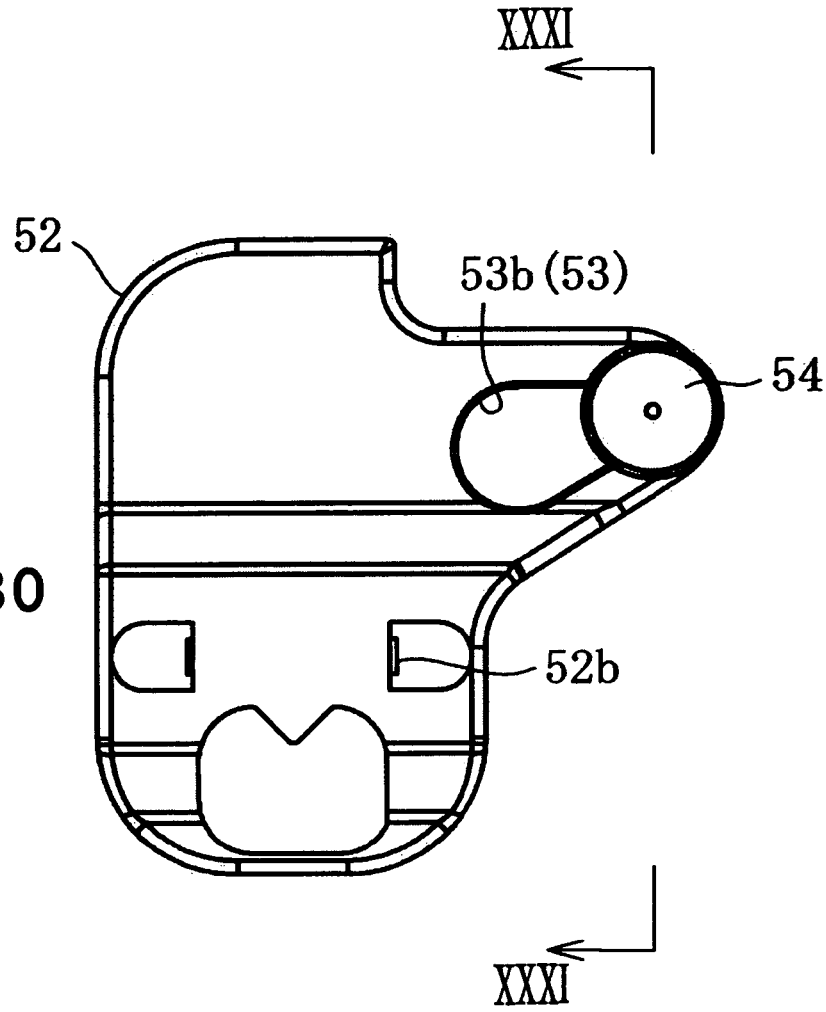
FIG. 30 is a plan view illustrating the lock portion in locked state.

Referring to FIGS. 27 and 29, a hole 53 is defined on the right end of the pin support 52. A first partially circular hole 53*a* is provided in the right side of the hole 53 and a second partially circular hole 53*b* communicating with the left end of the first partially circular hole 53*a* is configured in greater dimension than the first partially circular hole 53*a*. Two inwardly projecting and elastically deformable engagement projections 52*a* are formed on the peripheral edges of the portion extending across the first partially circular hole 53*a* and the second partially circular hole 53*b*. The dimension of the spacing between the projecting ends of the two engagement projections 52*a* are configured to be slightly smaller than the diameter of the engagement recess 55*a* of the later described pin 54. A guide 52*b* attached to the rail groove 51*d* of the base 51 is provided on the front half of the bottom surface of the pin support 52.

Figure 28:
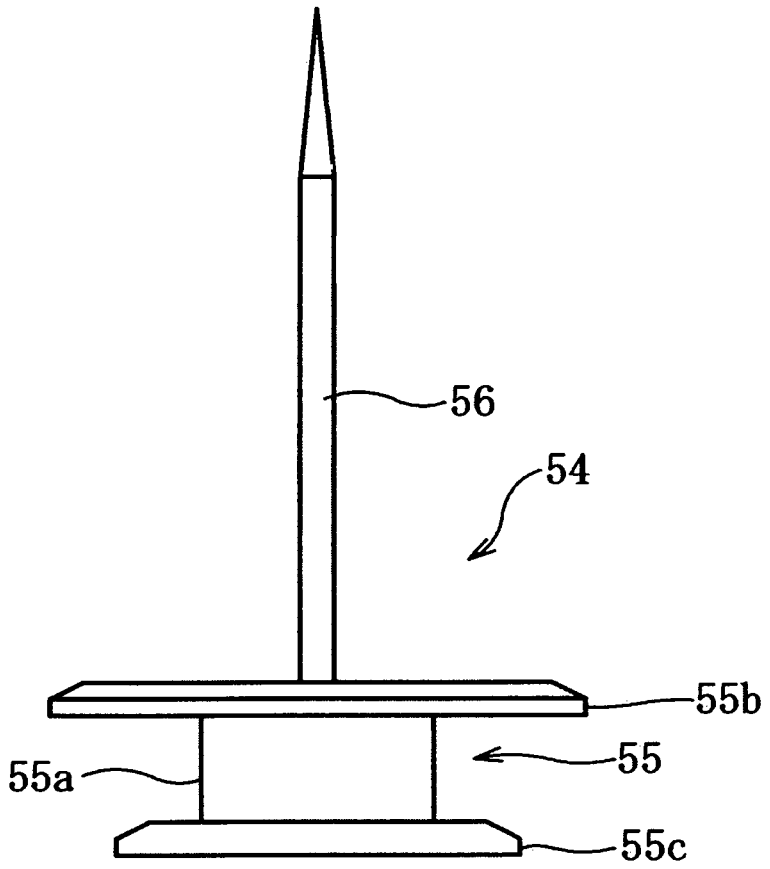
FIG. 28 corresponds to FIG. 19.

Referring to FIG. 28, the pin support 54 includes an engagement 55 and a needle 56 secured to the engagement 55. The engagement 55 establishes engagement with an engagement subject 57. The engagement subject 57 comprises the first partially circular hole 53*a* and the engagement projection 52*a* of the pin support 52. A collar 55*b* is provided on the upper end of the engagement 55 and the underside of the collar 55*b* is placed in abutment with the upper surface of the peripheral edges of the first partially circular hole 53*a* of the pin support 52. In the mid section of the engagement 55, an engagement recess 55*a* in the form of a groove is defined along the entire periphery of the side surface of the engagement 55 and the engagement recess 55*a* engages with the engagement subject 57. A collar 55*c* is provided on the lower end of the engagement 55. The radius of the engagement 55*a* is substantially equal to the radius of the first partially circular hole 53*a* and the radius of the collar 55*c* is slightly smaller than the radius of the second partially circular hole 53*b*.

Figure 31:
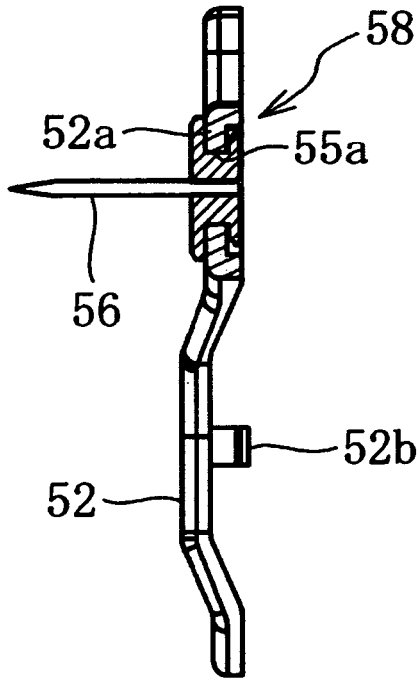
FIG. 31 is a cross-sectional view taken along line XXXI-XXXI of FIG. 30.

Referring to FIG. 31, the engagement 55*a* and the engagement recess 52*a* provided in the engagement subject 57 constitute a lock portion 58. The elastic deformation of the engagement projection 52*a* allows the disengagable engagement with the engagement recess 55*a*. When attaching the pin 54 on the pin support 52, the engagement 55 of the pin 54 is fitted into the second partially circular hole 53*b* from above. When the pin 54 is rightwardly moved from this state, the engagement recess 55*a* of the engagement 55 is placed in abutment with the inner surfaces of the two engagement projections 52*a*. When the pin 54 is further moved rightward against the elasticity of the engagement recesses 52*a*, the engagement recess 55*a* moves its way into the first partially circular hole 53*a* by spreading the engagement projections 52*a* outward relative to the hole 53. At this instance, elastic force is operated on the engagement recess 52*a* to return to its original position. The elasticity of the engagement 52*a* provides secure hold of the engagement recess 55*a* and the pin 54 is thus attached to the pin support 52 as shown by solid line in FIG. 27.

When removing the pin 54 from the pin support 52, the pin support 52 is moved to the left end of the base 51 as shown in double-dot chain-line in FIG. 27. Then, by leftwardly moving the pin 54 against the elasticity of the engagement projection 52*a*, the pin 54 moves its way into the second partially circular hole 53*b*. The engagement recess 55*a* is thus disengaged from the engagement projection 52*a* to allow the removal of the pin 54.

As described above, the engagement recess 55*a* has been provided on the engagement 55 and the elastically deformable engagement projections 52*a* have been provided on the engagement subject 57. The lock portion 58 disengagably holds the engagement recess 55*a* of the engagement 55 by elastic deformation of the engagement projections 52*a* of the engagement subject 57. Such configuration simplifies the structure of the lock portion 58 and contributes in reducing the number of parts which in turn reduces the manufacturing cost of the circular stitcher 50.

The present disclosure is not limited to the above described exemplary embodiments but may be modified or expanded as exemplified below.

The circular stitcher 10 may be attached on the bed 1 instead of the needle plate 1*a*.

In the first exemplary embodiment, the slope 17*f* may be formed in the lower side of the engagement catch 14*c* instead of the lower side of the engagement recess 17*b*. Also, in the second exemplary embodiment, the tapered slope may be formed in the lower side of the engagement catch 34*d* instead of the lower side of the engagement recess 38*a*.

In the first exemplary embodiment, the bottom surface of the pin 17 may be V-shaped, for example, instead of a curvature as long as a downwardly projected shape is employed.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A circular stitcher for a sewing machine having a bed, a needle plate, and a feed dog that feeds a workpiece cloth, the circular stitcher comprising:

a base attachable to an upper surface of the bed or the needle plate;

a pin support seized movably in a predetermined direction by the base and having an engagement subject;

a pin having an engagement engagable with the engagement subject of the pin support and a needle that pierces the workpiece cloth from an underside of the workpiece cloth at a laterally spaced position from a needle drop point, the needle assuming a center of rotational cloth feed executed by the feed dog during circular stitching; and a lock mechanism provided in the pin support and releasably locking the engagement and the engagement subject together.

2. The circular stitcher of claim 1, wherein the engagement has an engagement recess, the engagement subject has an engagement catch engagable with the engagement recess, the lock mechanism has an elastic element elastically biasing the engagement catch in a direction to establish engagement with the engagement recess and an operating portion that releases the engagement catch from the engagement recess, wherein, when engaging the engagement with the engagement subject, the engagement catch is engaged with the engagement recess against an elasticity of the elastic element and when releasing the engagement from the engagement subject, the engagement catch is moved in a direction moving away from the engagement recess in response to an operation of the operating portion.

3. The circular stitcher of claim 2, wherein the engagement and the needle provided in the pin are horizontally spaced from each other by a predetermined distance.

4. The circular stitcher of claim 2, wherein the engagement recess has a slope at least on a lower side thereof.

5. The circular stitcher of claim 1, wherein the engagement and the needle provided in the pin are horizontally spaced from each other by a predetermined distance.

6. The circular stitcher of claim 1, wherein the pin has a downwardly projecting bottom surface so that a tip of the pin is oriented sideways and not upward when the pin is removed from the pin support.

7. The circular stitcher of claim 6, wherein the pin includes a tab in an opposite side of the needle.

8. The circular stitcher of claim 1, wherein the engagement has an engagement recess, the engagement subject has an elastically deformable engagement projection, and the lock mechanism releasably holds the engagement recess of the engagement by elastic deformation of the engagement projection of the engagement subject.

9. The circular stitcher of claim 1, further comprising a screw that secures the base on the upper surface of the bed or the needle plate, wherein the base is selectively attachable in a first position where the pin support is positioned leftward relative to the needle drop point or in the second position where the pin support is positioned rightward relative to the needle drop point, and wherein when the base is attached in the second position, the screw regulates the movement of the pin support towards the needle drop point.

10. The circular stitcher of claim 1, wherein the pin support includes a cloth slider that provides support to the pin, the cloth slider having an upper surface that increases its height toward the pin when supporting the pin.

11. A sewing machine comprising:

a bed;

a needle plate;

a feed dog that feeds a workpiece cloth; and a circular stitcher that includes a base attachable to an upper surface of the bed or the needle plate, a pin support seized movably in a predetermined direction by the base and having an engagement subject, a pin having an engagement engagable with the engagement subject of the pin support and a needle that pierces the workpiece cloth from an underside of the workpiece cloth at a laterally spaced position from a needle drop point, the needle assuming a center of rotational cloth feed executed by the feed dog during circular stitching, and a lock mechanism provided in the pin support and releasably locking the engagement and the engagement subject together.

12. The sewing machine of claim 11, wherein the engagement has an engagement recess, the engagement subject has an engagement catch engagable with the engagement recess, the lock mechanism has an elastic element elastically biasing the engagement catch in the direction to establish engagement with the engagement recess and an operating portion that releases the engagement catch from the engagement recess, wherein when engaging the engagement with the engagement subject, the engagement catch is engaged with the engagement recess against an elasticity of the elastic element and when releasing the engagement from the engagement subject, the engagement catch is moved in a direction moving away from the engagement recess in response to an operation of the operating portion.

13. The sewing machine of claim 12, wherein the engagement and the needle provided in the pin are horizontally spaced from each other by a predetermined distance.

14. The sewing machine of claim 12, wherein the engagement recess has a slope at least on a lower side thereof.

15. The sewing machine of claim 11, wherein the engagement and the needle provided in the pin are horizontally spaced from each other by a predetermined distance.

16. The sewing machine of claim 11, wherein the pin has a downwardly projecting bottom surface so that a tip of the pin is oriented sideways and not upward when the pin is removed from the pin support.

17. The sewing machine of claim 16, wherein the pin includes a tab in an opposite side of the needle.

18. The sewing machine of claim 11, wherein the engagement includes an engagement recess, the engagement subject includes an elastically deformable engagement projection, and the lock mechanism releasably holds the engagement recess of the engagement by elastic deformation the engagement projection of the engagement subject.

19. The sewing machine of claim 11, wherein the circular stitcher includes a screw that secures the base on an upper surface of the bed or the needle plate, and the base can be attached in a first position where the pin support is positioned leftward relative to the needle drop point or in the second position where the pin support is positioned rightward relative to the needle drop point, and wherein when the base is attached in the second position, the screw regulates the movement of the pin support towards the needle drop point.

20. The sewing machine of claim 11, wherein the pin support includes a cloth slider that provides support to the pin, the cloth slider having an upper surface that increases its height toward the pin when supporting the pin.

* * * * *